US011524291B2

(12) United States Patent
Kersaudy-Kerhoas et al.

(10) Patent No.: US 11,524,291 B2
(45) Date of Patent: Dec. 13, 2022

(54) FLUIDIC DEVICE

(71) Applicant: Heriot-Watt University, Edinburgh (GB)

(72) Inventors: Maiwenn Kersaudy-Kerhoas, Edinburgh (GB); Antonio Liga, Edinburgh (GB)

(73) Assignee: HERIOT-WATT UNIVERSITY, Edinburgh (GB)

( * ) Notice: Subject to any disclaimer, the term of this patent is extended or adjusted under 35 U.S.C. 154(b) by 14 days.

(21) Appl. No.: 17/042,656

(22) PCT Filed: Mar. 29, 2019

(86) PCT No.: PCT/GB2019/050934
§ 371 (c)(1),
(2) Date: Sep. 28, 2020

(87) PCT Pub. No.: WO2019/186204
PCT Pub. Date: Oct. 3, 2019

(65) Prior Publication Data

US 2021/0031195 A1 Feb. 4, 2021

(30) Foreign Application Priority Data

Mar. 29, 2018 (GB) ..... 1805166

(51) Int. Cl.
*B01L 3/00* (2006.01)

(52) U.S. Cl.
CPC ..... *B01L 3/502715* (2013.01); *B01L 2200/06* (2013.01); *B01L 2200/16* (2013.01); *B01L 2300/044* (2013.01); *B01L 2400/0487* (2013.01)

(58) Field of Classification Search
CPC .. B01L 3/502715; B01L 3/5027; B01L 3/502; B01L 3/50; B01L 2200/06;
(Continued)

(56) References Cited

U.S. PATENT DOCUMENTS

2007/0102362 A1 5/2007 Iida et al.
2014/0255193 A1 9/2014 Tsai et al.
(Continued)

FOREIGN PATENT DOCUMENTS

CN 102631959 A 8/2012
DE 102015218665 A1 3/2017
(Continued)

OTHER PUBLICATIONS

International Searching Authority, International Search Report and Written Opinion for International Application No. PCT/GB2019/050934, dated May 16, 2019, (12 pages), European Patent Office, Rijswijk, Netherlands.
International Searching Authority, International Search Report and Written Opinion for International Application No. PCT/GB2019/050935, dated May 17, 2019, (17 pages), European Patent Office, Rijswijk, Netherlands.
(Continued)

*Primary Examiner* — Christine T Mui
(74) *Attorney, Agent, or Firm* — Alston & Bird LLP

(57) ABSTRACT

A fluidic device (10) is described. The fluidic device (10) comprises the first part (110) and the second part (120). The first part (110) comprises a first inlet (111) and a first outlet (112), mutually spaced apart. The second part (120) comprises a first chamber (121) arranged to contain a predetermined first amount A1 of a first fluid F1 therein and a first wall portion (122) arranged to contain, at least in part, the first fluid F1 in the first chamber (121). The fluidic device (10) is arrangeable in a first configuration, wherein the first part (110) is fluidically isolated from the first chamber (121). The fluidic device (10) is arrangeable in a second configuration, wherein the first inlet (111) and the first outlet (112) are fluidically coupled via the first chamber (121), whereby increasing a first pressure P1 in the first chamber (121) via the first inlet (111) urges at least a part of the predetermined first amount A1 of the first fluid F1 through the first outlet (112).

17 Claims, 15 Drawing Sheets

(58) Field of Classification Search
CPC ..... B01L 2200/16; B01L 2300/044; B01L 2400/0487
USPC ..... 422/504, 500
See application file for complete search history.

(56) References Cited

U.S. PATENT DOCUMENTS

| | | | | |
|---|---|---|---|---|
| 2014/0378348 | A1* | 12/2014 | Makarewicz, Jr. | B01L 3/50273 506/40 |
| 2017/0291174 | A1 | 10/2017 | Makarewicz, Jr. et al. | |
| 2018/0272344 | A1 | 9/2018 | Brettschneider et al. | |

FOREIGN PATENT DOCUMENTS

| | | | |
|---|---|---|---|
| KR | 10-2011-0005963 | A | 1/2011 |
| WO | WO-2011/106384 | A1 | 9/2011 |
| WO | WO-2016/005741 | A1 | 1/2016 |
| WO | WO-2017/055039 | A1 | 4/2017 |
| WO | WO-2017/179064 | A1 | 10/2017 |

OTHER PUBLICATIONS

Great Britain Search Report for Great Britain Patent Application No. 1805166.4, dated Sep. 19, 2018, (3 pages), Intellectual Property Office, South Wales, Great Britain.

Great Britain Search Report for Great Britain Patent Application No. 1805145.8, dated Oct. 1, 2018, (5 pages), Intellectual Property Office, South Wales, Great Britain.

Zhang, Jinlong et al. *A Lab-On-CD Prototype For High-Speed Blood Separation*, Journal Of Micromechanics and Microengineering, vol. 18, Issue 12, 125025, Nov. 20, 2008. DOI: 10.1088/0960-1317/18/12/125025.

Xue, Xiangdong et al. *Analysis Of Fluid Separation In Microfluidic T-Channels*, Applied Mathematical Modelling, vol. 36, No. 2, (2012), pp. 743-755.

Maria, M. Sneha et al. *Development Of A Microfluidic Device For Cell Concentration and Blood Cell-Plasma Separation*, Biomedical Microdevices, vol. 17, No. 6:115, pp. 1-19. DOI: 10.1007/10544-015-0017-z, 2015.

* cited by examiner

70

FLUIDIC DEVICE

CROSS REFERENCE TO RELATED APPLICATIONS

This application is a National Stage Application, filed under 35 U.S.C. § 371, of International Application No. PCT/GB2019/050934, filed Mar. 29, 2019, which international application claims priority to and the benefit of United Kingdom Application No. 1805166.4, filed Mar. 29, 2018; the contents of both of which as are hereby incorporated by reference in their entireties.

BACKGROUND

Related Field

The present invention relates to fluidic devices, for example blister packs for use with laboratory on a chip devices for point of care applications.

Description of Related Art

Typically, a blister pack is a pre-formed plastic package used for solids or liquids, including small consumer goods, foods, and pharmaceuticals. The blister pack typically comprises a chamber (also known as a blister, a pocket or a cavity) arranged to contain a solid or a liquid therein. The chamber is typically formed from a formable web, usually a thermoformed material comprising a thermoplastic. The blister pack also comprises a closure for the cavity, for example a foil (also known as a lidding seal, a film or a frangible cover) such as provided for a liquid-filled blister pack, typically comprising a plurality of layers. A liquid may be expelled from the chamber by pressing thereon, manually by hand or mechanically by machine, and thus collapsing it. Such a chamber is thus a collapsible chamber. The blister back may be designed to rupture at a pre-determined region, for example at an interface between the chamber and the foil, once a first pressure inside the chamber reaches a rupture threshold as the blister is forcibly collapsed, thereby reducing an internal volume thereof. A blister pack that folds onto itself may be known as a clamshell blister pack.

Efforts have been made to reduce the scale of analytical systems required to perform medical diagnostic tests. For instance, laboratory on a chip (LOC) devices have been developed which enable medical diagnostic tests to be performed using microfluidic devices (also known as microfluidic cartridges), for example for point of care (POC) applications. Reagents are typically required for these medical diagnostic tests. The reagents may be included in liquid-filled blister packs and may be expelled into the microfluidic devices at appropriate stages during test cycles.

A problem arises in that it may be difficult to control an amount of liquid expelled from a liquid-filled blister pack. Accurate and/or precise (also known as reproducible) control of the amount of the liquid expelled may be important for medical diagnostic tests and may affect results thereof. For example, by pressing manually by hand on a collapsible chamber, the amount of the liquid expelled may be dependent on at least a location, a depth and/or a rate of pressing. While pressing mechanically by machine on a collapsible chamber may be expected to improve accuracy and/or a precision of the amount of the liquid expelled, a cost and/or complexity of the machine may preclude POC application.

Hence, there is a need to improve control of an amount of liquid expelled from a liquid-filled blister pack, for example for use with LOC devices for POC applications.

BRIEF SUMMARY

It is one aim of the present invention, amongst others, to provide a fluidic device which at least partially obviates or mitigates at least some of the disadvantages of the prior art, whether identified herein or elsewhere. For instance, it is an aim of embodiments of the invention to provide a fluidic device that improves control of an amount of a fluid, for example a liquid, expelled therefrom, for example that improves accuracy and/or a precision of the amount of the fluid expelled therefrom. For instance, it is an aim of embodiments of the invention to provide a fluidic device that improves control of an amount of a fluid, for example a liquid, expelled therefrom, for example for use with LOC devices for POC applications.

According to the first aspect, there is provided a fluidic device comprising a first part and a second part;

wherein the first part comprises a first inlet and a first outlet, mutually spaced apart;

wherein the second part comprises a first chamber arranged to contain a predetermined first amount of a first fluid therein and a first wall portion arranged to contain, at least in part, the first fluid in the first chamber;

wherein the fluidic device is arrangeable in:

a first configuration, wherein the first part is fluidically isolated from the first chamber; and a second configuration, wherein the first inlet and the first outlet are fluidically coupled via the first chamber, whereby increasing a first pressure in the first chamber via the first inlet urges at least a part of the predetermined first amount of the first fluid through the first outlet.

A second aspect of the invention provides use of controlled translation of a body for mixing of a liquid in a microfluidic device, wherein the translation of the body through the liquid is due to a potential field acting on the body.

A third aspect of the invention provides use of controlled translation of a gas bubble to coalesce a first liquid portion with an adjacent second liquid portion in a microfluidic device.

A fourth aspect of the invention provides a process of mixing a liquid by controlling translation of a body therethrough, comprising:

receiving a liquid in a microfluidic chamber;

introducing a body into the liquid; and controlling translation of the body through the liquid, wherein the translation of the body is due to a potential field acting on the body;

whereby the controlled translation of the body mixes the liquid.

A fifth aspect of the invention provides a microfluidic device comprising a microfluidic chamber, having an inlet, and arranged to receive a liquid therein;

wherein, in use, the microfluidic device is arranged to control translation through the liquid of a body introduced therein, wherein the translation of the body is due to a potential field acting on the body;

whereby the controlled translation of the body mixes the liquid.

A sixth aspect of the invention provides a fluidic device according to the first aspect comprising a microfluidic device according to the fifth aspect.

A seventh aspect of the invention provides an apparatus arranged to control a fluidic device according to the sixth aspect.

A eighth aspect of the invention provides a microfluidic system comprising an apparatus according to the seventh aspect and a fluidic device according to the sixth aspect.

A ninth aspect of the invention provides a method of operating a microfluidic system according to the eighth aspect.

A tenth aspect provides a method of controlling a fluidic device according to the first aspect, the method comprising:

moving the fluidic device from the first configuration to the second configuration; and increasing a first pressure in the first chamber via the first inlet thereby urging at least a part of the predetermined first amount of the first fluid through the first outlet.

According to the present invention there is provided a fluidic device, as set forth in the appended claims. Also provided is a method of controlling such a fluidic device. Other features of the invention will be apparent from the dependent claims, and the description that follows.

According to the first aspect, there is provided a fluidic device comprising a first part and a second part;

wherein the first part comprises a first inlet and a first outlet, mutually spaced apart;

wherein the second part comprises a first chamber arranged to contain a predetermined first amount of a first fluid therein and a first wall portion arranged to contain, at least in part, the first fluid in the first chamber;

wherein the fluidic device is arrangeable in:

a first configuration, wherein the first part is fluidically isolated from the first chamber; and a second configuration, wherein the first inlet and the first outlet are fluidically coupled via the first chamber, whereby increasing a first pressure in the first chamber via the first inlet urges at least a part of the predetermined first amount of the first fluid through the first outlet.

In this way, the fluidic device improves control of an amount of first fluid expelled therefrom, since the part of the predetermined first amount (for example volume and/or mass) of the first fluid urged through the first outlet is controlled, at least in part, by increasing the first pressure in the first chamber via the first inlet. Hence, by controlling the increase in pressure in the first chamber, an accuracy and/or a precision of the part of the predetermined first amount of the first fluid urged through the first outlet is improved. In this way, inaccuracy and/or imprecision resulting from pressing manually by hand on a collapsible chamber of a conventional blister pack is eliminated by the fluidic device. Furthermore, in this way, a cost and/or complexity may be reduced compared with pressing mechanically by machine on a collapsible chamber of a conventional blister pack. In addition, since the first fluid is urged through the first outlet by increasing the first pressure in the first chamber via the first inlet, rather than by collapsing the first chamber as for the conventional blister pack, the fluidic device is relatively more compact than the conventional blister pack since a conventional collapsible chamber is eliminated. Additionally, both smaller and larger predetermined first amounts of the first fluid may be contained in the first chamber compared with the conventional blister pack since the conventional collapsible chamber is eliminated. In this way, the fluidic device is suitable for use with LOC devices for POC applications.

Particularly, by urging at least the part of the predetermined first amount of the first fluid through the first outlet by increasing the first pressure in the first chamber via the first inlet, substantially all or even all of the predetermined first amount of the first fluid may be urged through the first outlet. This contrasts with conventional collapsible liquid-filled blister packs, in which expelling of a full amount of liquid originally contained therein is not possible due to dead volumes forming during collapsing. Hence, when substantially all or even all of the predetermined first amount of the first fluid is urged through the first outlet of the fluidic device, an accuracy and/or a precision of the predetermined first amount of the first fluid in the first chamber is determinative, rather than control of the increase in pressure in the first chamber, for example. Since the predetermined first amount of the first fluid may be automatically dispensed into the first container during manufacture thereof, for example, the accuracy and/or the precision of the predetermined first amount of the first fluid in the first chamber may be tightly controlled to high levels. Where the first fluid is a liquid, the predetermined first amount of the first fluid may thus be a predetermined first volume and/or a predetermined first mass thereof.

The fluidic device comprises the first part and the second part. In one example, the first part comprises and/or is a LOC device and the second part contains a reagent for the LOC device i.e. the predetermined first amount of the first fluid in the first chamber is the reagent for the LOC device. In one example, the first part and the second part are separate (i.e. physically separate or distinct) parts. In one example, the first part and the second part are respective parts or regions of a single part, component, article or device, for example the fluidic device. In one example, the first part and the second part are integrally formed i.e. as a single component, article or device.

The first part comprises the first inlet and the first outlet, mutually spaced apart. That is, the first inlet and the first outlet are separate (i.e. physically separate or distinct) passageways or apertures provided in the first part.

The second part comprises the first chamber arranged to contain the predetermined first amount of the first fluid therein. The first chamber may be known as a vessel, a container, a cavity or a housing, arranged to contain, for example hold or receive, the predetermined first amount of the first fluid therein. In one example, the predetermined first amount of the first fluid is in a range from 1 μl to 100 ml, preferably in a range from 2 μl to 50 ml, more preferably in a range from 5 μl to 10 ml. In one example, the predetermined first amount of the first fluid is in a range from 1 μl to 1 ml, preferably in a range from 2 μl to 500 μl, more preferably in a range from 5 μl to 100 μl. In one example, the predetermined first amount of the first fluid is in a range from 1 ml to 100 ml, preferably in a range from 2 ml to 50 ml, more preferably in a range from 5 ml to 20 ml.

It should be understood that the predetermined first amount of the first fluid therein is thus a defined amount, for example dispensed or dosed into the first container. In one example, the first fluid is a liquid.

In one example, the first chamber comprises no internal corners or dead volumes. In this way, up to all of the predetermined first amount of the first fluid may be urged through the first outlet.

In one example, the second part comprises and/or is a liquid-fillable blister pack comprising a blister, wherein the first chamber is provided by the blister.

The second part comprises the first wall portion arranged to contain, at least in part, the first fluid in the first chamber.

It should be understood that in the first configuration, the first fluid is isolated in the first chamber, for example sealed therein, such as required for storage. That is, the first wall portion and remaining walls (i.e. a second wall portion) of the first chamber define a closed chamber (also known as a closed container) in the first configuration. In one example, the first chamber is a closed chamber wherein the first wall portion is arranged to close the first chamber. In one example, the first wall portion is arranged to sealingly contain, at least in part, the first fluid in the first chamber in the first configuration, for example by being sealed around a periphery of the first chamber. In one example, the first wall portion foil comprises a foil (also known as a lidding seal, a film, or a frangible cover), comprising one or more layers. In one example, the first wall portion comprises no perforations therethrough in the first configuration. In one example, the first chamber comprises no perforations therethrough in the first configuration. In one example, the first wall portion is a perforatable (also known as a pierceable) wall portion. In one example, the first wall portion comprises a first layer coupled to a first edge of the first chamber.

In one example, the second part is formed, at least in part, from a sheet material and wherein the first chamber comprises a concavity formed therein.

In one example, the first chamber comprises a set of antechambers, including a first inlet antechamber, a first outlet antechamber and, optionally a second outlet antechamber, arranged to correspond with the first inlet, the first outlet and optionally, a second outlet respectively of the corresponding first part of the fluidic device. In one example, an antechamber of the set thereof has a second wall portion arranged to support the first wall portion, for example during perforation thereof, for example by substantially surrounding the antechamber. In one example, the first chamber comprises relatively narrow passageways connecting a main part of the first chamber to the respective antechambers, for example having a width in a range from 20 to 1000 μm, preferably in a range from 50 to 500 μm. In one example, an antechamber of the set thereof has a size, for example a diameter, in a range from 500 to 5000 μm, preferably in a range from 1000 to 2500 μm. In one example, the first inlet antichamber and the first outlet antechamber are arranged proximal and/or at a first side of the first chamber, whereby the first inlet antichamber and the first outlet antechamber are arrangeable in use (for example, by arranging the second part vertically) proximal and/or at a lower side, preferably a lowermost side, of the first chamber in use. In one example, the second outlet antechamber is arranged proximal an opposed second side of the first chamber, whereby the second outlet antechamber is arrangeable in use (for example, by arranging the second part vertically) proximal and/or at an upper side, preferably an uppermost side, of the first chamber. In one example, the first part comprises the first inlet, the first outlet and optionally a second outlet arranged to correspond (i.e. positioned) with the first inlet antechamber, the first outlet antechamber and, optionally the second outlet antechamber, respectively.

The fluidic device is arrangeable in the first configuration, wherein the first part is fluidically isolated from the first chamber. It should be understood that the first configuration is a storage configuration i.e. when the fluidic device is not in use. In one example, the fluidic device is arrangeable in the first configuration, wherein the first part is fluidically isolated from the first fluid contained in the first chamber. In other words, the first inlet and/or the first outlet are not fluidically coupled to the first chamber in the first configuration. That is, the first inlet and/or the first outlet are not in fluid communication with the first fluid in the first chamber in the first configuration.

The fluidic device is arrangeable in the second configuration, wherein the first inlet and the first outlet are fluidically coupled via the first chamber. That is, in the second configuration, a first fluidic path is defined from the first inlet to the first outlet through the first chamber. It should be understood that the second configuration is an in use configuration i.e. when the fluidic device is in use.

In one example, the fluidic device is arranged to move from the first configuration to the second configuration by the first inlet and the first outlet perforating through the first wall portion into the first chamber. That is, the first inlet and the first outlet perforate (also known as pierce) through the first wall portion, thereby providing respective passageways into the first chamber. Since the first inlet and the first outlet are mutually spaced apart, the respective passageways are correspondingly mutually spaced apart. In one example, the fluidic device is arranged to move from the first configuration to the second configuration by the first inlet and the first outlet perforating through the first wall portion into the first chamber, thereby providing a first inlet passageway and a first outlet passageway from the first part into the first chamber of the second part. In one example, the first inlet passageway and the first outlet passageway are mutually spaced apart.

In one example, the fluidic device is arranged to move from the first configuration to the second configuration by the first inlet and the first outlet displacing respective seals provided in the second part, for example in, through and/or on the first wall portion. In one example, the fluidic device is arranged to move from the first configuration to the second configuration by the first inlet and the first outlet coupling with respective one direction valves (also known as one way valves) provided in the second part, for example in, through and/or on the first wall portion. In one example, the fluidic device is arranged to move from the first configuration to the second configuration by the first inlet and the first outlet pushing respective screws that seal respective holes (also known as apertures) provided in the second part, for example in, through and/or on the first wall portion, whereby pushing the respective screws opens the holes.

In the second configuration, increasing the first pressure in the first chamber via the first inlet urges at least a part of the predetermined first amount of the first fluid through the first outlet. Hence, by increasing the first pressure in the first chamber via the first inlet, for example by introducing a gas or a liquid into the first chamber through the first inlet, at least the part of the predetermined first amount of the first fluid is urged (i.e. driven or pumped) through the first outlet in turn, as described above.

In one example, the first inlet and the first outlet comprise respective perforation members, for example respective needles having passageways therethrough, arranged to perforate through the first wall portion. Example needles include conical needles and bevel needles, having open or closed tips. An example needle may have a closed tip such as a pencil-point tip (i.e. a sharpened closed tip) and an orifice in a side wall of the needle, proximal to the tip. In this way, blockage of the orifice by a part of the first wall portion during perforation of the first wall portion may be avoided. In one example, the perforation member is arranged to receive a sealing member, for example around a base thereof. In this way, the first inlet and/or the first outlet may be arranged to fluidically seal against the first wall portion in the second configuration. In one example, the first inlet and/or the first outlet comprises a sealing member, for example a gasket or an O-ring.

In one example, the first wall portion is a perforatable (also known as a pierceable) wall portion.

In one example, the first part comprises a surface, for example a planar surface, arranged to confront and/or contact the first wall portion and the first inlet and the first outlet extend away from the surface. In one example, a length of the first inlet extending away from the surface is equal to a length of the first outlet extending away from the surface. In one example, a length of the first inlet extending away from the surface is less than a length of the outlet extending away from the surface. In this way, the first outlet may extend deeper into the predetermined first amount of the first fluid in the first chamber in the second configuration. In one example, respective locations of the first inlet and the first outlet correspond with a location of the first chamber. In one example, a length of the first inlet and a length of the first outlet correspond with a depth, for example respective depths, of the first chamber. In one example, a length of the first outlet corresponds with, for example is at most, a maximum depth of the first chamber and/or a location of the first outlet corresponds with a location of the maximum depth of the first chamber. In this way, substantially all or even all of the predetermined first amount of the first fluid may be urged through the first outlet since the first may extend, for example fully, into the predetermined first amount of the first fluid in the first chamber in the second configuration. In one example, a length of the first inlet and/or the first outlet is in a range from 0.1 mm to 10 mm, preferably in a range from 0.5 mm to 5 mm, more preferably in a range from 1 mm to 3 mm, for example 1.5 mm, 2.0 mm or 2.5 mm.

In one example, the first wall portion is arranged to fluidically seal around the first inlet and/or the first outlet in the second configuration, and/or vice versa. In this way, by increasing the first pressure in the first chamber via the first inlet, the part of the predetermined first amount of the first fluid is constrained (limited, restricted) to be urged through the first outlet, rather than leak or seep, for example, via another fluid flow path. Other sealing mechanisms are possible. In one example, the first inlet and/or the first outlet is arranged to fluidically seal against the first wall portion in the second configuration. In one example, a region, for example a surface region) of the first part is arranged to fluidically seal against the first wall portion in the second configuration.

In one example, the fluidic device comprises a first coupling member arranged to couple, for example mechanically couple and/or interlock, the first part and the second part in the second configuration. In this way, the first coupling member may control, at least in part, perforation of the first inlet and the second inlet through the first wall portion, for example a depth and/or a force of perforation, thereby improving the accuracy and/or the precision of the part of the predetermined first amount of the first fluid urged through the first outlet is improved. In this way, the first part and the second part may be held together, for example securely together, in the second configuration. In one example, the first coupling member comprises a mechanical coupling member, for example a fastener or a releasable fastener, such as provided by a clamp, a latch, a catch or a barb on the first part arranged to fasten through an aperture in or against a surface of the second part, or vice versa. In one example, the fluidic device comprises a plurality of such first coupling members.

In one example, the fluidic device comprises a second coupling member arranged to moveably, for example slideably or rotatably, couple the first part and the second part in the first configuration and/or the second configuration. In this way, the first part and the second part may be provided together and/or to guide movement of the fluidic device from the first configuration to the second configuration, for example to control locations of the first wall portion through which the first inlet and the first outlet perforate. In one example, the second coupling member comprises a guide or a slide, arranged to slideably couple the first part and the second part in the first configuration and/or the second configuration, to guide movement of the fluidic device from the first configuration to the second configuration. In one example, the second coupling member comprises a hinge or a pivot, arranged to rotatably couple the first part and the second part in the first configuration and/or the second configuration, to guide movement of the fluidic device from the first configuration to the second configuration. In one example, the second coupling member is provided by a portion of the fluidic device having a reduced thickness.

In one example, the first part comprises a plurality of first outlets, as described with respect to the first outlet. In this way, by increasing the first pressure in the first chamber via the first inlet, at least parts of the predetermined first amount of the first fluid may be urged through the plurality of first outlets.

In one example, the first part comprises a plurality of first inlets and first outlets, mutually spaced apart, as described with respect herein to the first inlet and the first outlet, and the second part comprises a plurality of first chambers arranged to contain predetermined first amounts of respective first fluids therein and a plurality of respective first wall portions arranged to contain, at least in part, the respective first fluids in the plurality of first chambers, as described herein with respect to the first chamber and the first wall portion. That is, the plurality of first chambers are mutually fluidically isolated in the first configuration and/or the second configuration.

In one example, the first part comprises a second inlet, fluidically coupled to the first outlet via a channel, and a second outlet, mutually spaced apart;

the second part comprises a second chamber arranged to contain a predetermined second amount of a second fluid therein and a second wall portion arranged to contain, at least in part, the predetermined second amount of the second fluid in the second chamber;

wherein the first part is fluidically isolated from the second chamber in the first configuration; and wherein the second inlet and the second outlet are fluidically coupled via the second chamber, in the second configuration, whereby increasing the first pressure in the first chamber via the first inlet urges at least a part of the predetermined second amount of the second fluid through the second outlet.

The second inlet, the second outlet, the second chamber, the predetermined second amount of the second fluid, the second fluid and/or the second wall portion may be as described herein with respect to the first inlet, the first outlet, the first chamber, the predetermined first amount of the first fluid, the first fluid and the first wall portion, respectively.

That is, the first chamber and the second chamber are mutually fluidically isolated in the first configuration and the first chamber and the second chamber are fluidically coupled in the second configuration. That is, in the second configuration, a first fluidic path is defined from the first inlet to the second outlet via (i.e. through) the first chamber, the second inlet and the second chamber. Hence, by increasing the first pressure in the first chamber via the first inlet, the part of the predetermined first amount of the first fluid is urged through the first outlet and hence through the second inlet into the second chamber, thereby increasing a second pressure in the second chamber and urging at least the part of the predetermined second amount of the second fluid through the second outlet. In other words, in the second configuration, the first chamber and the second chamber are daisy-chained.

In one example, the fluidic device is arranged to move from the first configuration to the second configuration by the second inlet and the second outlet perforating through the second wall portion into the second chamber.

In on example, the first inlet is fluidically couplable to a gas source, whereby gas provided by the gas source is arranged to displace the first fluid via the first inlet. In one example, the gas source comprises and/or is a pressurised cylinder, a pressurised reservoir, syringe or a pump.

In one example, the fluidic device is a microfluidic device.

In one example, the fluidic device comprises the first fluid and/or the second fluid.

In one example, the first fluid is a reagent, preferably a reagent for a biological assay. In one example, the second fluid is a reagent, preferably a reagent for a biological assay.

In one example, the first chamber comprises a set of antechambers, including a first inlet antechamber, a first outlet antechamber and, optionally a second outlet antechamber, and the first part comprises the first inlet, the first outlet and optionally, a second outlet respectively corresponding therewith. A method of mixing the predetermined first amount of the first fluid and pumping the predetermined first amount of the first fluid out of the first chamber is described below, which combines with the method according to the tenth aspect. The predetermined first amount of the first fluid partially fills the first chamber. In use, the fluidic device is moved from the first configuration to the second configuration by the by the first inlet, the first outlet and the second outlet perforating through the first wall portion into the antechambers respectively of the first chamber. The fluidic device is arranged vertically. Initially, the first inlet, the first outlet and the second outlet are closed, for example using respective valves. The first inlet and the second outlet are opened. With the first outlet closed and the second outlet open, gas is introduced into the first chamber via the open first inlet to mix the predetermined first amount of the first fluid. This gas exits the first chamber via the second outlet, which is open. The second outlet is closed and the first outlet is opened. Gas introduced into the first chamber via the first inlet is pressurised in the first chamber above the predetermined first amount of the first fluid, because the second outlet is closed, and urges the predetermined first amount of the first fluid exit the first chamber via the first outlet, which is open. Since the first inlet antichamber and the first outlet antechamber are arranged at the lowermost side of the first chamber, substantially all of the predetermined first amount of the first fluid may be pumped out of the first chamber via the first outlet antechamber. In this way, by controlling the opening and closing of the first outlet and the second outlet and the introduction of gas, the predetermined first amount of the first fluid may be mixed in situ using the gas before being pumped out of the first chamber using the gas.

LOC Device

The second aspect of the invention provides use of controlled translation of a body for mixing of a liquid in a microfluidic device, wherein the translation of the body through the liquid is due to a potential field acting on the body.

Typically, bodies such as free bodies in microfluidic devices are problematic, restricting and/or impeding translation or flow of the liquid. For example, a gas pocket in a channel of the microfluidic device may prevent flow of the liquid, for example, due to compressibility of the gas pocket. Additionally and/or alternatively, the gas pocket may separate adjacent portions of the liquid, inhibiting mixing between the adjacent portions of the liquid. Additionally and/or alternatively, a free solid body may become trapped, thereby forming a partial blockage or a blockage in the channel. Additionally and/or alternatively, the body and/or translation of the body may affect sensors coupled to the microfluidic device, thereby disrupting sensed measurements. Hence, bodies in microfluidic devices are generally undesirable.

Contrary to conventional practice, the inventors have found that the controlled translation of the body through the liquid is effective in mixing the liquid, while not resulting in the problems typically associated with free bodies. Without wishing to be bound by any theory, the controlled translation of the body may promote turbulence in the liquid, thereby promoting mixing of the liquid. Additionally and/or alternatively and without wishing to be bound by any theory, the controlled translation of the body may disrupt lamellar flow of the liquid and/or promote turbulent flow of the liquid, thereby promoting mixing of the liquid.

It should be understood that the liquid may comprise one or more liquid components, for example a plurality of liquid components. Two or more of this plurality of liquid components may be different. The liquid may comprise a first liquid component, for example, a solvent, a solution or a reagent. The liquid may comprise a second liquid component, for example, a biological sample and/or a biological liquid (also known as biological fluid or bodily fluid) such as blood, blood plasma, saliva, urine, amniotic fluid, cerebrospinal fluid, pleural fluid, aqueous humour, synovial fluid or semen. In this way, use of the controlled translation of the body mixes the liquid, for example, mixes the plurality of liquid components, thereby increasing a homogeneity of the liquid and/or enhancing a reaction between one or more of the plurality of liquid components.

One or more of the plurality of liquid components may be miscible or substantially miscible with the other liquid components of the plurality of liquid components. Mixing of such miscible or substantially miscible liquid components may tend to form a solution, for example. Additionally and/or alternatively, one or more of the liquid components may be immiscible or substantially immiscible with the other liquid components of the plurality of liquid components. Mixing of such immiscible or substantially immiscible liquid components may form an emulsion, for example.

The liquid may be static or substantially static. That is, the liquid may not flow during mixing. Alternatively, the liquid may be dynamic. That is, the liquid may flow during mixing. For example, where the liquid comprises a plurality of liquid components, the liquid may comprise a plurality of co-flowing liquids, such as during continuous flow microfluidics.

It should be understood that the body is a free body, translating through the liquid due to the potential field acting on the body. That is, the body is partially or wholly within the liquid, for example, partially or wholly surrounded by the liquid. That is, the body is not coupled, for example, to the microfluidic device. For example, the body is not mechanically coupled to the microfluidic device.

The body may comprise a solid, a liquid and/or a gas. For example, the body may comprise a particle, a droplet and/or a bubble. For example, the body may comprise a particle of a solid, such as a hollow body or a solid body. For example, the body may comprise a droplet of an immiscible liquid. For example, the body may comprise a gas bubble. In an example embodiment, the body is a gas bubble.

The body may be chemically and/or biologically inert. That is, the body may be compatible with biological samples, for example. Alternatively, the body may be chemically and/or biologically active and/or reactive. For example, the body may react with biological samples. For example, the body may comprise a catalyst. In an example embodiment, the body is a gas bubble, wherein the gas comprises nitrogen. For example, the gas bubble may be an air bubble.

The body may have a density different from or equal to a density of the liquid and/or a density of a liquid component of the liquid. For example, the body may have a density greater than, less than, substantially equal to or equal to the density of the liquid and/or a density of a liquid component of the liquid. For example, the body may be positively buoyant, negatively buoyant or neutrally buoyant in the liquid. For example, if the body is positively buoyant, the body may tend to ascend in the liquid. For example, if the body is negatively buoyant, the body may tend to descend in the liquid. For example, if the body is neutrally buoyant, the body may tend to neither ascend nor descend in the liquid.

The potential field acting on the body may comprise a gravitational potential field, an electrical potential field and/or a magnetic potential field. Typically, effects due to the gravitational potential field of the Earth, for example, are negligible in microfluidics due to dominance of other microscale-related effects. For example, if the potential field acting on the body comprises the gravitational potential field, the translation of the body through the liquid may be due in part to a difference between the density of the body and the density of the liquid. For example, if the potential field acting on the body comprises the electrical potential field, the translation of the body through the liquid may be due in part to an electrical charge of the body. That is, the body may comprise the electrical charge. For example, if the potential field acting on the body comprises the magnetic potential field, the translation of the body through the liquid may be due in part to a magnetism of the body. For example, the body may comprise a ferromagnetic, ferrimagnetic, paramagnetic or diamagnetic part. In an example embodiment, the potential field acting on the body is the gravitational potential field.

The translation of the body is through the liquid. That is, due to the translation of the body through the liquid, the body is displaced by a displacement d. The displacement d may be on a scale of a dimension of the body. For example, if the body has a diameter or width of D, the displacement d of the body may be D, 10 D, 100 D, 1000 D, or more. For example, a gross displacement and a net displacement of the body may be non-zero. Alternatively, the net displacement of the body may be zero while the gross displacement of the body may be non-zero, if the translation of the body is in a circular path or if the translation of the body is reciprocal, for example. That is, a mean speed of the body may be non-zero while a mean velocity of the body may be zero. For example, the body may move though the liquid with a constant or non-constant non-zero speed or velocity. That is, a component of the velocity of the body may be non-zero. For example, the body may move though the liquid linearly or non-linearly. The translation of the body may comprise an oscillation or vibration such as cyclic contraction and expansion of the body, in addition to the displacement.

The microfluidic device may comprise a microfluidic channel or a chamber containing the liquid therein, the channel or the chamber having a dimension such as diameter or width of less than 3000 μm, less than 2000 μm, less than 1000 μm, less than 500 μm, less than 250 μm or less than 100 μm. A dimension of the body may be less than a dimension of the microfluidic device.

For example, the diameter D of the body may be less than an internal diameter or bore of the microfluidic device. For example, a maximum dimension of the body may be less than a minimum dimension of the microfluidic device. For example, a ratio of the maximum dimension of the body to the minimum dimension of the microfluidic device may be at least 1:2, at least 1:3, at least 1:4, at least 1:5, at least 1:10, at least 1:20 or at least 1:50

The translation of the body through the liquid is controlled. Control of the translation of the body may be passive and/or active. Control of the translation of the body may be due at least in part to the potential field acting on the body. For example, the potential field acting on the body may be controlled, thereby in turn controlling the translation of the body through the liquid. For example, the electric potential field or the magnetic potential field may be applied, thereby applying an electrically induced force or a magnetically induced force respectively on the body. The electric potential field or the magnetic potential field may be varied, for example increased or decreased, thereby varying the electrically induced force or the magnetically induced force respectively on the body. Control of the translation of the body may be due at least in part to an interaction between the body and the microfluidic device. For example, the body may interact with a surface of the microfluidic device. For example, an attractive interaction such as due to friction between the body and the surface of the microfluidic device may counter the translation of the body, such as slowing the speed of the translation of the body. For example, such attractive interaction opposes, at least in part, the potential field acting on the body. For example, the friction between the body and the inner surface of the microfluidic chamber may oppose, at least in part, the gravitational potential field such that the translation of the body may not accelerate continuously due to the gravitational potential field. For example, the translation of the body through the liquid may be thus at a substantially constant speed in the gravitational potential field. Control of the translation of the body through the liquid may be due at least in part to an interaction between the body and the liquid. Control of the translation of the body through the liquid may be due at least in part to the liquid. For example, a viscosity of the liquid may control the translation of the body therethrough. In an example embodiment, the translation of the body through the liquid is controlled at least in part by the interaction between the body and the microfluidic device.

In an example embodiment, the body is a gas bubble. Typically, gas bubbles are particularly problematic in microfluidic devices and thus usually, efforts are made to avoid or remove the gas bubbles. Contrary to conventional practice, the inventors have found that the controlled translation of the gas bubble through the liquid is effective in mixing the liquid.

In an example embodiment, the second aspect comprises a plurality of such bodies.

In an example embodiment, the use comprises the controlled translation of the gas bubble for mixing of the liquid in the microfluidic device, wherein the translation of the gas bubble through the liquid is due to the gravitational potential field acting on the gas bubble, wherein the translation of the gas bubble through the liquid is controlled at least in part by the interaction between the gas bubble and the microfluidic device. The density of the gas bubble is less than the density of the liquid such that the gas bubble is positively buoyant in the liquid. Hence, the gas bubble tends to ascend in the liquid. Acceleration of the gas bubble during such ascension may be opposed by the interaction between the gas bubble and the surface of the microfluidic device. For example, the ascension of the gas bubble may be at a substantially constant speed for at least a part of the translation.

The third aspect of the invention provides use of controlled translation of a gas bubble to coalesce a first liquid portion with an adjacent second liquid portion in a microfluidic device.

For example, the first liquid portion and the second liquid portion may be initially separated by a gas pocket or volume, for example, contained within the microfluidic device, for example a microfluidic channel. The first liquid portion may be, for example, contained within a syringe connected to the microfluidic channel, or contained in a first chamber or in any arrangement of channels and chambers connected to the microfluidic channel. The second liquid portion may be contained in a second chamber, connected to the microfluidic channel. As the first liquid portion is pushed through the microfluidic channel, the gas pocket contained therein is forced towards the second chamber. Due to a geometry of an inlet of the second chamber and/or physical properties of liquid, gas and walls of the second chamber, the gas pocket entering the second chamber may generate gas bubbles which may ascend, in a manner controlled by a geometry of the second chamber, while the second liquid portion remains within the second chamber. Once the gas is removed and the microfluidic channel is filled with the first liquid portion, the first liquid portion and the second liquid coalesce.

The fourth aspect of the invention provides a process of mixing a liquid by controlling translation of a body therethrough, comprising:

receiving a liquid in a microfluidic device;

introducing a body into the liquid; and controlling translation of the body through the liquid, wherein the translation of the body is due to a potential field acting on the body;

whereby the controlled translation of the body mixes the liquid.

Features of the fourth aspect, for example the liquid, the controlled translation, the body, the microfluidic chamber and/or the potential field, may be as described with respect to the second aspect.

Receiving the liquid in the microfluidic device may comprise receiving the liquid in the microfluidic device via an inlet of the microfluidic device. Receiving the liquid in the microfluidic device may comprise receiving the liquid in the microfluidic device into a channel or a chamber of the microfluidic device. Receiving the liquid in the microfluidic device may comprise dispensing, flowing, pouring, injecting and/or pumping the liquid into the microfluidic device. Receiving the liquid in the microfluidic device may comprise receiving a first liquid component, or part thereof, of the liquid in the microfluidic device and subsequently, receiving a second (or at least one further) liquid component, or part thereof, of the liquid in the microfluidic device. For example, a reagent may be dispensed into the microfluidic device and subsequently, a biological sample may be pumped into the reagent previously received in the microfluidic device. For example, the reagent and the biological sample may co-flow into the microfluidic device. The first liquid component and the second liquid component may be received via the same inlet or via different inlets of the microfluidic device, for example, via a first inlet and a second inlet respectively. The first liquid component and the second liquid component may be received at the same flow rates or at different flow rates, for example a first flow rate and a second flow rate respectively. The first liquid component and the second liquid component may be received at the same volumes or at different volumes, for example a first volume and a second volume respectively. Liquid pockets for part of the liquid components might be introduced within the microfluidic device during manufacturing.

Introducing the body into the liquid may comprise receiving the liquid in the microfluidic device in the microfluidic device and subsequently, receiving the body in the microfluidic device. That is, the body may be added to the liquid, for example, immersed into the liquid or formed in the liquid. For example, the liquid may be received into the microfluidic device and subsequently, a gas bubble may be generated in the liquid. Alternatively, introducing the body into the liquid may comprise receiving the body in the microfluidic device and subsequently, receiving the liquid, or part thereof, in the microfluidic device. For example, if the body comprises a solid, the solid body may be inserted into the microfluidic device and the liquid subsequently pumped into the microfluidic device.

Controlling the translation of the body through the liquid, wherein the translation of the body is due to the potential field acting on the body, may comprise controlling the potential field acting on the body. For example, a strength and/or direction of the potential field may be controlled. Controlling the translation of the body through the liquid may be static or dynamic. For example, if the body is a gas bubble and the potential field comprises the gravitational potential field, controlling the translation of the gas bubble through the liquid may comprise controlling an angle of inclination a of the microfluidic device whereby an interaction between the gas bubble and a surface of the microfluidic device controls a rate of ascent of the gas bubble through the liquid. For example, controlling the angle of inclination a of the microfluidic device may be static, for example the angle of inclination a of the microfluidic device may be predetermined or fixed during use, such that the translation of the gas bubble is substantially at a constant speed or velocity. Alternatively, controlling the angle of inclination a of the microfluidic device may be dynamic, for example the angle of inclination a of the microfluidic device may be changed during use, such that the translation of the gas bubble may accelerate or decelerate.

In this way, the liquid may be effectively mixed.

The fifth aspect of the invention provides a microfluidic device comprising a microfluidic chamber, having an inlet, and arranged to receive a liquid therein;

wherein, in use, the microfluidic device is arranged to control translation through the liquid of a body introduced therein, wherein the translation of the body is due to a potential field acting on the body;

whereby the controlled translation of the body mixes the liquid.

Features of the fifth aspect, for example the liquid, the controlled translation, the body, the microfluidic chamber and/or the potential field, may be as described with respect to the second aspect and/or the fourth aspect.

The inlet may comprise a perforation or passageway through a wall of the microfluidic chamber. The inlet may comprise a liquid inlet. For example, the liquid may be received into the microfluidic chamber via the inlet. The inlet may comprise a body inlet. For example, the body may be introduced into the microfluidic chamber via the inlet. In an example embodiment, the body is a gas bubble and the gas bubble is introduced into the liquid via the inlet. The microfluidic device may comprise a plurality of inlets. For example, the microfluidic device may comprise a liquid inlet, wherein the liquid is received into the microfluidic chamber via the liquid inlet, and a body inlet, wherein the body is introduced into the liquid via the body inlet. For example, the microfluidic device may comprise a liquid inlet, wherein the liquid is received into the microfluidic chamber via the liquid inlet, and a gas inlet, wherein a gas bubble is introduced into the liquid via the gas inlet. For example, the microfluidic device may comprise a first liquid inlet, wherein a first liquid component of the liquid is received into the microfluidic chamber via the first liquid inlet, a second liquid inlet, wherein a second liquid component of the liquid is received into the microfluidic chamber via the second liquid inlet and, optionally, a gas inlet. The inlet may be arranged to control introduction of the body into the liquid. The inlet may be arranged to form, create or generate the body. For example, if the body is a gas bubble, the inlet may be arranged to create the gas bubble, such as from a gas in fluid communication with the inlet. For example, the inlet may comprise a gas nozzle. A shape and/or size of the inlet may be arranged to control introduction of the body into the liquid. For example, the inlet may comprise a round shape, suitable for generating a gas bubble. For example, the inlet may comprise a size suitable for generating a gas bubble having a required size, such as a diameter or width D. For example, a ratio of a cross-sectional area of the inlet to a cross-sectional area of the microfluidic chamber proximal the inlet may be at least 1:1, at least 1:2, at least 1:5, at least 1:10, at least 1:20, at least 1:50 or at least 1:100. There may be a critical gas velocity $U_b=2\times10^{-3}$ m·s−1 at which bubbling occurs and another critical gas velocity $U_s=5\times10^{-2}$ m·s$^{-1}$ at which the bubbling behaviour gives way to a slug behaviour enabling the displacement of the liquid in the microfluidic chamber. For mixing, the gas velocity is preferably in the range from $U_b$ to $U_s$. For transfer of the liquid by displacement from the microfluidic chamber, the gas velocity is preferably at least $U_s$. Bubble size may depend on gas flow rate $U_b$, gas-liquid-wall surface tension, fluid viscosity/density and inlet geometry (angle β).

The microfluidic device may comprise an outlet. The outlet may comprise a perforation or passageway through a wall of the microfluidic chamber. The liquid and/or the body may exit the microfluidic device via the outlet. The inlet may be arranged proximal one end of the microfluidic chamber and the outlet may be arranged proximal another end, for example a distal end and/or an opposed end, of the microfluidic chamber. The inlet may comprise the outlet. That is, the liquid may be received into the microfluidic chamber via the inlet and the liquid may also exit the microfluidic chamber via the inlet, i.e. which then acts as an outlet. The device may comprise more than one outlet. For example multiple outlets may be closed and open in concert to direct flow towards different outlets. In another scenario multiple outlets might be open at the same time. For example multiple outlets may be used to separate portion of fluids with different densities. In an example embodiment, the outlet is in fluid communication with the inlet via the microfluidic chamber.

The microfluidic chamber may comprise a channel, a passageway or a lumen, arranged to receive the liquid therein. The microfluidic chamber may have a dimension, for example a diameter or a width or an effective diameter or an effective width, of less than 3000 μm, less than 2000 μm, less than 1000 μm, less than 500 μm, less than 250 μm or less than 100 μm. The microfluidic chamber may have an aspect ratio (i.e. a ratio of length or effective length to diameter or effective diameter or width or effective width) of at least 10, at least 20, at least 50, at least 100, at least 200, at least 500, at least 1000. The microfluidic chamber may have a volume (i.e. an internal volume for receiving the liquid) of less than 10 μl, less than 20 μl, less than 50 μl, less than 100 μl, less than 200 μl, less than 500 μl or less than 1000 μl. A cross-section of the microfluidic chamber may comprise curved sides, for example only curved sides such as a circular or an oval cross-section. A cross-section of the microfluidic chamber may comprise straight sides, for example a polygonal, a square or a rectangular cross-section. A cross-section of the microfluidic chamber may comprise both curved sides and straight sides.

A cross-section of the microfluidic chamber may be constant along a length of the microfluidic chamber. For example, microfluidic chamber may be tubular or substantially tubular. Alternatively, a cross-section of the microfluidic chamber may be non-constant along a length of the microfluidic chamber. For example, a shape of the cross-section of the microfluidic chamber may be constant along a length of the microfluidic chamber while a size of the cross-section of the microfluidic chamber may be non-constant along a length of the microfluidic chamber. For example, the size of the cross-section of the microfluidic chamber may increase along the length of the microfluidic chamber, thereby affording expansion and/or reduction of back pressure, for example. Alternatively, the shape of the cross-section of the microfluidic chamber may be non-constant along the length of the microfluidic chamber while the size of the cross-section of the microfluidic chamber may be constant along a length of the microfluidic chamber. Alternatively, the shape and the size of the cross-section of the microfluidic chamber may be non-constant along the length of the microfluidic chamber.

The microfluidic chamber may comprise a wall. The wall may be arranged to, in part, control translation through the liquid of the body. The wall may comprise a plurality of wall portions, for example an upper or first wall portion opposed to a lower or second wall portion. The wall may further comprise opposed side wall portions, for example third and fourth wall portions, therebetween. A wall portion of the plurality of wall portions may be arranged to, in part, control translation through the liquid of the body. For example, the first wall portion may be arranged to, in part, control translation through the liquid of the body. For example, the first wall portion may be arranged to oppose, at least in part, a force on the body due to the potential field acting on the body. For example, the first wall portion may be arranged transversally to a direction of the force on the body due to the potential field acting on the body. For example, the first wall portion may inhibit or reduce movement or a speed of movement of the body through the liquid due to the potential field acting on the body. For example, if the potential field is a gravitational potential field and the body is a gas bubble, the first wall portion may be arranged transversally with respect to the gravitational potential field and thereby inhibit or hinder ascension of the gas bubble through the liquid. The first wall portion may be inclined or tilted with respect to the second side wall portion. That is, the first and second wall portions may not be parallel. For example, if the potential field is a gravitational potential field and the body is a gas bubble, the first wall portion may be arranged inclined with respect to the gravitational potential field such that the gas bubble moves along the first wall portion through the liquid. That is, the first wall portion provides a tilted ceiling for the microfluidic chamber. An angle of inclination a of the first wall portion with respect to the second wall portion may be constant along a length, or a substantial length, of the microfluidic chamber. An angle of inclination a of the first wall portion with respect to the second wall portion may be non-constant along a length, or a substantial length, of the microfluidic chamber. For example, an angle of inclination a of the first wall portion with respect to the second wall portion may be at least 2°, at least 3°, at least 4° or at least 5°. For example, an angle of inclination a of the first wall portion with respect to the second wall portion may be in a range 0.5° to 50°, a range 2° to 40° or a range 3° to 45°. An angle of inclination a of the first wall portion with respect to the second wall portion may be dependent on a width or diameter of the microfluidic chamber. For example, an angle of inclination a of the first wall portion with respect to the second wall portion may be inversely dependent on or inversely proportional to a width or diameter of the microfluidic chamber. For example, an angle of inclination a may be in a range 4° to 5° for a width of 2000 μm. For example, an angle of inclination a may be in a range 25° to 30° for a width of 200 μm. The wall may be arranged boustrophedonically. That is, the wall may be arranged in a zig-zag manner, alternately left to right then right to left, for example. In this way, an effective length of the microfluidic chamber may be increased for a given size or net length of the microfluidic chamber, thereby increasing an efficiency of mixing while increasing space utilization, for example of a cartridge comprising the microfluidic chamber. Such a boustrophedonic arrangement of the wall may provide relatively longer portions of the microfluidic chamber arranged transversally to and alternately with relatively shorter portions of the microfluidic chamber. The wall may be arranged spirally or helically, so as to similarly increase an efficiency of mixing for a given size or net length of the microfluidic chamber.

The microfluidic chamber may comprise no perforations or passageways, other than the inlet and the optional outlet. The microfluidic chamber may have an inner surface. The inner surface may be arranged to facilitate flow, for example laminar flow. For example, the inner surface may be smooth, thereby facilitating flow by reducing drag. The inner surface may be arranged to increase mixing, for example by promoting turbulent flow. For example, the inner surface may comprise one or more protrusions and/or recesses, thereby promoting turbulent flow and hence increasing mixing.

The microfluidic chamber may be arranged to reduce or avoid dead volumes, for example, by reducing or eliminating internal corners or recesses. Corners of the microfluidic chamber may be chamfered or radiused, to facilitate flow of the liquid and/or reduce or avoid dead volumes.

The microfluidic device may comprise a plurality of such microfluidic chambers. For example, the microfluidic device may comprise a first microfluidic chamber and at least a second microfluidic chamber, wherein the first microfluidic chamber and the second microfluidic chamber are fluidically coupled. For example, an outlet of the first microfluidic chamber may be fluidically coupled to the inlet of the second microfluidic chamber. The first microfluidic chamber and the second microfluidic chamber may be fluidically coupled via a syphon. The syphon may be arranged to prevent the liquid from the first microfluidic chamber transferring to the second microfluidic chamber or vice versa, for example even when hydrostatic heads of the liquids in the first microfluidic chamber and second microfluidic chamber are different. The syphon may be arranged to receive a gas. The gas received in the syphon may isolate liquids received in the first microfluidic chamber and the second microfluidic chamber. The syphon may be arranged to permit a gas from the first microfluidic chamber transferring to the second microfluidic chamber or vice versa. For example, if the body is a gas bubble, the gas bubble may be introduced into the liquid in the first microfluidic chamber, via the inlet thereof, translate through the liquid thereby mixing the liquid, exit the first microfluidic chamber via the outlet thereof and hence be introduced into the liquid in the second microfluidic chamber, via the inlet thereof. The syphon may be arranged to permit the liquid from the first microfluidic chamber transferring to the second microfluidic chamber or vice versa, for example due to an increased pressure applied to the liquid in the first microfluidic chamber via the inlet thereof. For example, by increasing a fluid pressure at the inlet of the first microfluidic chamber, the liquid received in the first microfluidic chamber may be transferred to the second microfluidic device.

The microfluidic device may be chemically and/or biologically inert. That is, the microfluidic device may be compatible with biological samples, for example. Alternatively, the microfluidic device may be chemically and/or biologically active and/or reactive. For example, the microfluidic device may react with biological samples. For example, the microfluidic device may comprise a catalyst. The microfluidic device may comprise a material having such properties. A wall of the microfluidic device may comprise such a material. An internal surface of the microfluidic device may comprise such a material. For example, the microfluidic device may comprise a polymeric composition comprising a polymer, a metal such as an alloy and/or a ceramic. For example, the microfluidic device may a polymeric composition comprising a polymer such as poly (methyl methacrylate) (PMMA). For example, the microfluidic device may comprise a metal such as a stainless steel such as 316 stainless steel. For example, the microfluidic device may comprise a ceramic such as silicon dioxide. An internal surface of the microfluidic device may comprise a coating of such a material.

The sixth aspect of the invention provides a fluidic device according to the first aspect comprising a microfluidic device according to the fifth aspect. The fluidic device comprises the first part and the second part. In one example, the first part comprises and/or is a LOC device comprising the microfluidic device and the second part contains a reagent for the LOC device i.e. the predetermined first amount of the first fluid in the first chamber is the reagent for the LOC device. The fluidic device according to the sixth aspect may also be known as a microfluidic cartridge.

The fluidic device may be suitable for biological analysis of a biological sample and/or a biological liquid, as described previously. The fluidic device may comprise a plurality of microfluidic devices according to the fifth aspect. The plurality of microfluidic devices may be fluidically coupled. The fluidic device may comprise a filter, arranged to filter the liquid. The fluidic device may comprise a reservoir, arranged to hold a liquid component. The fluidic device may comprise a membrane, arranged to adsorb a part of the liquid. The fluidic device may comprise a valve connector. The fluidic device may comprise an inlet and/or an outlet. The fluidic device may comprise one or more passageways fluidically coupled to one or more of the microfluidic devices, such that, for example, one or more reagents may be received into the one or more of the microfluidic devices via the one or more passageways.

The seventh aspect of the invention provides an apparatus arranged to control a fluidic device according to the sixth aspect. The apparatus may comprise a controller, one or more pumps or injectors, one or more valves, one or more heaters and/or one or more detectors. The controller may be arranged to control at least one of the one or more pumps, at least one of the one or more valves and/or at least one of the one or more detectors The controller may be arranged to control a flow rate of the liquid into and/or through the microfluidic device and/or the fluidic device. For example, the controller may be arranged to control one of the one or more pumps or injectors to pump or inject the liquid into the microfluidic device and/or fluidic device at a flow rate of less than 0.1 μl/s, less than 1 μl/s, less than 5 μl/s or less than 10 μl/s, for example about 2.8 μl/s. The controller may be arranged to control a flow rate of a gas into and/or through the microfluidic device and/or fluidic device. For example the controller may be arranged to control one of the one or more pumps or injectors to pump or inject the gas into the microfluidic device and/or fluidic device at a flow rate of less than 1 μl/s, less than 1 μl/s, less than 5 μl/s, less than 10 μl/s, less than 100 μl/s, or less than 200 μl/s or less than 500 μl/s or less than 1000 μl/s for example about 28 μl/s or about 169 μl/s. In this way, the microfluidic device may provide gas bubbles from the gas. For example the controller may be arranged to control one of the one or more pumps or injectors to pump or inject the gas into the microfluidic device and/or fluidic device at a flow rate of more than 10 μl/s, more than 20 μl/s, more than 50 μl/s, more than 100 μl/s, more than 200 μl/s, more than 500 μl/s or more than 1000 μl/s, for example about 153 μl/s. In this way, the microfluidic device may provide a gas buffer for transferring the liquid between microfluidic chambers.

The eighth aspect of the invention provides a microfluidic system comprising an apparatus according to the seventh aspect and a fluidic device according to the sixth aspect.

The ninth aspect of the invention provides a method of operating a microfluidic system according to the eighth aspect.

The tenth aspect provides a method of controlling a fluidic device according to the first aspect, the method comprising:

moving the fluidic device from the first configuration to the second configuration; and increasing a first pressure in the first chamber via the first inlet thereby urging at least a part of the predetermined first amount of the first fluid through the first outlet.

The method may include any of the steps described herein.

Definitions & Combinations of Features

Throughout this specification, the term "comprising" or "comprises" means including the component(s) specified but not to the exclusion of the presence of other components. The term "consisting essentially of" or "consists essentially of" means including the components specified but excluding other components except for materials present as impurities, unavoidable materials present as a result of processes used to provide the components, and components added for a purpose other than achieving the technical effect of the invention, such as colourants, and the like.

The term "consisting of" or "consists of" means including the components specified but excluding other components.

Whenever appropriate, depending upon the context, the use of the term "comprises" or "comprising" may also be taken to include the meaning "consists essentially of" or "consisting essentially of", and also may also be taken to include the meaning "consists of" or "consisting of".

The optional features set out herein may be used either individually or in combination with each other where appropriate and particularly in the combinations as set out in the accompanying claims. The optional features for each aspect or exemplary embodiment of the invention, as set out herein are also applicable to all other aspects or exemplary embodiments of the invention, where appropriate. In other words, the skilled person reading this specification should consider the optional features for each aspect or exemplary embodiment of the invention as interchangeable and combinable between different aspects and exemplary embodiments.

BRIEF DESCRIPTION OF THE FIGURES

For a better understanding of the invention, and to show how exemplary embodiments of the same may be brought into effect, reference will be made, by way of example only, to the accompanying diagrammatic Figures, in which:

FIG. 22 schematically depicts a second part of a fluidic device in the second configuration, in use, according to an exemplary embodiment.

DETAILED DESCRIPTION OF VARIOUS EMBODIMENTS

Figure 1:
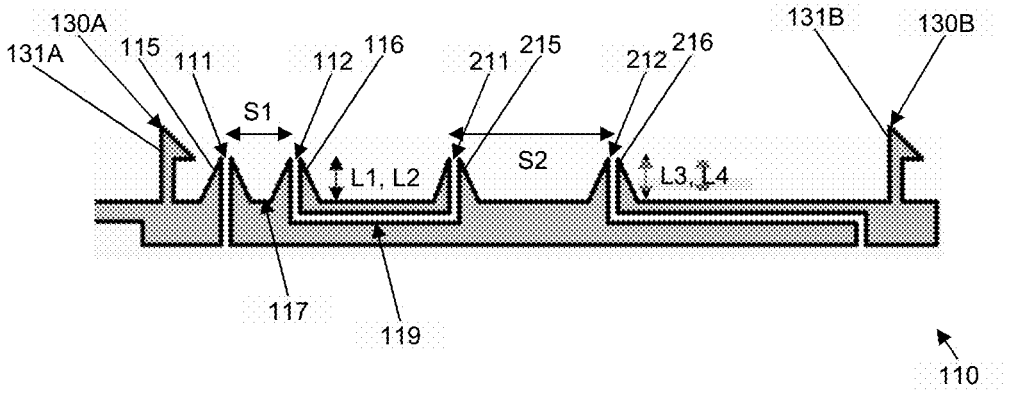
FIG. 1 schematically depicts a first part of a fluidic device in a first configuration according to an exemplary embodiment.
Figure 2:
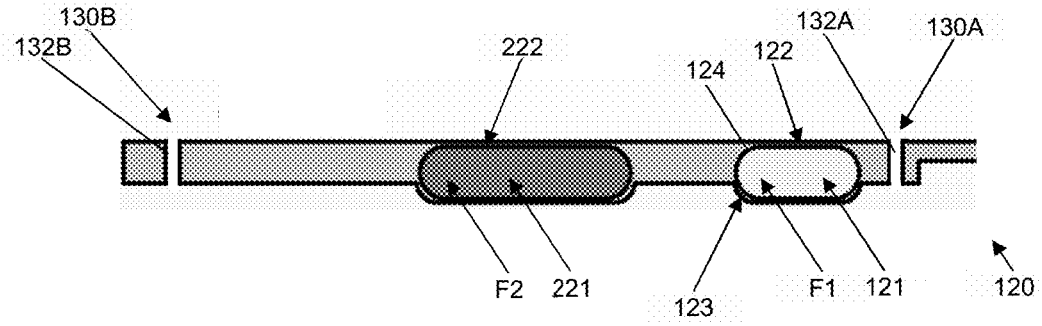
FIG. 2 schematically depicts a second part of the fluidic device of FIG. 1 in the first configuration according to an exemplary embodiment.
Figure 3:
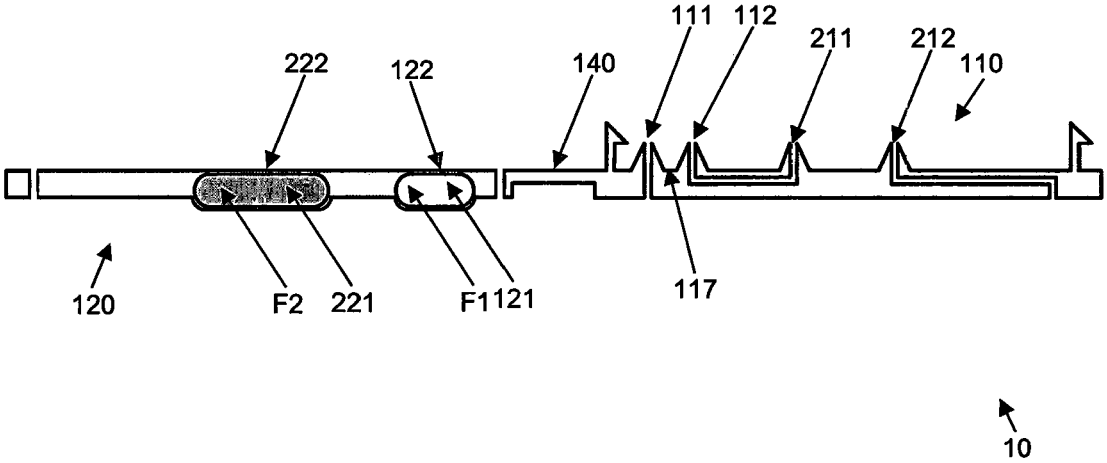
FIG. 3 schematically depicts the fluidic device of FIGS. 1 and 2 in the first configuration, in more detail.
Figure 4:
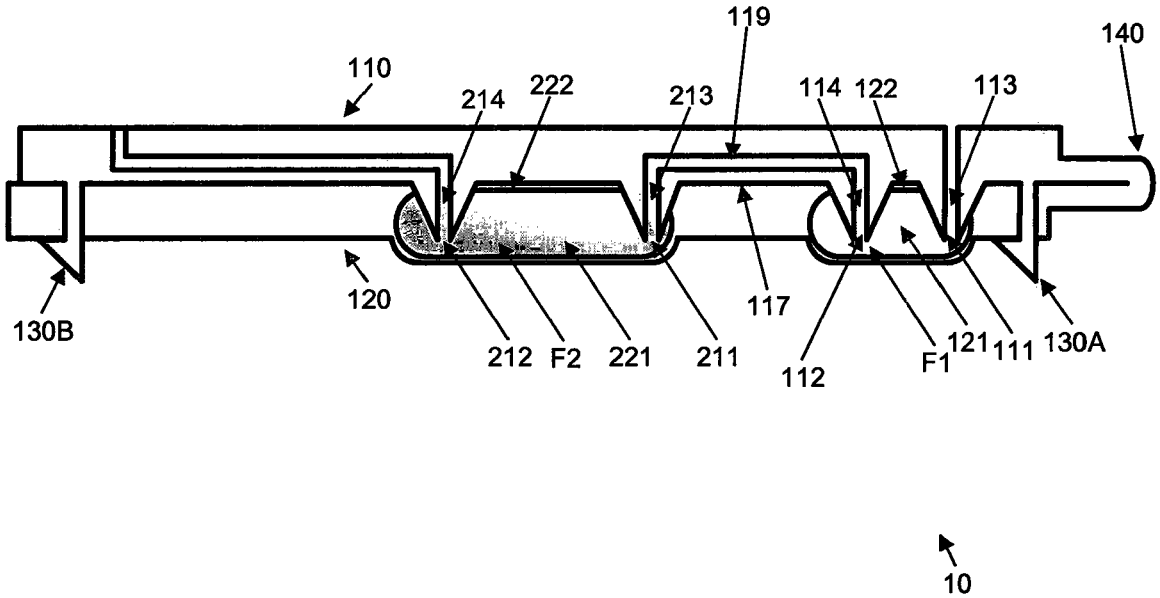
FIG. 4 schematically depicts the fluidic device of FIGS. 1 and 2 in a second configuration according to an exemplary embodiment.

FIGS. 1 to 3 schematically depict a fluid device 10 according to an exemplary embodiment in a first configuration and FIG. 4 schematically depicts the fluidic device 10 in a second configuration.

FIG. 1 schematically depicts a first part 110 of the fluidic device 10 in the first configuration according to an exemplary embodiment. Particularly, FIG. 1 is a longitudinal cross-sectional view of the first part 110 of the fluidic device 10 in the first configuration, as described below in more detail.

FIG. 2 schematically depicts a second part 120 of the fluidic device 10 of FIG. 1 in the first configuration according to an exemplary embodiment. Particularly, FIG. 2 is a longitudinal cross-sectional view of the second part 120 of the fluidic device 10 in the first configuration, as described below in more detail.

FIG. 3 schematically depicts the fluidic device 10 of FIGS. 1 and 2 in the first configuration, in more detail. Particularly, FIG. 3 is a longitudinal cross-sectional view of the first part 110 and the second part 120 of the fluidic device 10 in the first configuration, as described below in more detail.

FIG. 4 schematically depicts the fluidic device 10 of FIGS. 1 and 2 in a second configuration according to an exemplary embodiment. Particularly, FIG. 4 is a longitudinal cross-sectional view of the fluidic device 10 in the second configuration.

In more detail, the fluidic device 10 comprises the first part 110 and the second part 120. The first part 110 comprises a first inlet 111 and a first outlet 112, mutually spaced apart. The second part 120 comprises a first chamber 121 arranged to contain a predetermined first amount A1 of a first fluid F1 therein and a first wall portion 122 arranged to contain, at least in part, the first fluid F1 in the first chamber 121. The fluidic device 10 is arrangeable in a first configuration, wherein the first part 110 is fluidically isolated from the first chamber 121. The fluidic device 10 is arrangeable in a second configuration, wherein the first inlet 111 and the first outlet 112 are fluidically coupled via the first chamber 121, whereby increasing a first pressure P1 in the first chamber 121 via the first inlet 111 urges at least a part of the predetermined first amount A1 of the first fluid F1 through the first outlet 112. In this example, the fluidic device 10 is arranged to move from the first configuration to the second configuration by the first inlet 111 and the first outlet 112 perforating through the first wall portion 122 into the first chamber 121.

In this way, the fluidic device 10 improves control of an amount of first fluid F1 expelled therefrom, since the part of the predetermined first amount A1 of the first fluid F1 urged through the first outlet 112 is controlled, at least in part, by increasing the first pressure P1 in the first chamber 121 via the first inlet 111. Hence, by controlling the increase in first pressure P1 in the first chamber 121, an accuracy and/or a precision of the part of the predetermined first amount A1 of the first fluid F1 urged through the first outlet 112 is improved. In this way, the inaccuracy and/or imprecision resulting from pressing manually by hand on a collapsible chamber of a conventional blister pack is eliminated by the fluidic device 10. Furthermore, in this way, a cost and/or complexity may be reduced compared with pressing mechanically by machine on a collapsible chamber of a conventional blister pack. In this way, the fluidic device 10 is suitable for use with LOC devices for POC applications.

Particularly, by urging at least the part of the predetermined first amount A1 of the first fluid F1 through the first outlet 112 by increasing the first pressure P1 in the first chamber 121 via the first inlet 111, substantially all or even all of the predetermined first amount A1 of the first fluid F1 may be urged through the first outlet 112. This contrasts with conventional collapsible liquid-filled blister packs, in which expelling of a full amount of liquid originally contained therein is not possible due to dead volumes forming during collapsing. Hence, when substantially all or even all of the predetermined first amount A1 of the first fluid F1 is urged through the first outlet 112 of the fluidic device 10, an accuracy and/or a precision of the predetermined first amount A1 of the first fluid F1 in the first chamber 121 is determinative, rather than control of the increase in first pressure P1 in the first chamber 121, for example. Since the predetermined first amount A1 of the first fluid F1 may be automatically dispensed into the first container during manufacture thereof, for example, the accuracy and/or the precision of the predetermined first amount A1 of the first fluid F1 in the first chamber 121 may be tightly controlled to high levels.

The fluidic device 10 comprises the first part 110 and the second part 120. In this example, the first part 110 comprises and/or is a LOC device and the second part 120 contains a reagent for the LOC device i.e. the predetermined first amount A1 of the first fluid F1 in the first chamber 121 is the reagent for the LOC device. In this example, the first part 110 and the second part 120 are respective parts of a single device, particularly the fluidic device 10. In this example, the first part 110 and the second part 120 are integrally formed.

In this example, the first inlet 111 and the first outlet 112 are mutually spaced apart by a first spacing S1.

In this example, the first chamber 121 comprises no internal corners or dead volumes. In this way, up to all of the predetermined first amount A1 of the first fluid F1 may be urged through the first outlet 112.

It should be understood that in the first configuration, the first fluid F1 is isolated in the first chamber 121, for example sealed therein, such as required for storage. That is, the first wall portion 122 and remaining walls (i.e. a second wall portion 123) of the first chamber 121 define a closed chamber (also known as a closed container) in the first configuration. In this example, the first chamber 121 is a closed chamber wherein the first wall portion 122 is arranged to close the first chamber 121. In this example, the first wall portion 122 is arranged to sealingly contain, at least in part, the first fluid F1 in the first chamber 121 in the first configuration, for example by being sealed around a periphery of the first chamber 121. In this example, the first wall portion 122 foil comprises a foil, comprising one or more layers. In this example, the first wall portion 122 comprises no perforations therethrough in the first configuration. In this example, the first chamber 121 comprises no perforations therethrough in the first configuration. In this example, the first wall portion 122 is a perforatable (also known as a pierceable) wall portion. In this example, the first wall portion 122 comprises a first layer coupled to a first edge 124 of the first chamber 121.

In this example, the second part 120 is formed, at least in part, from a sheet material and wherein the first chamber 121 comprises a concavity formed therein.

The fluidic device 10 is arrangeable in the second configuration, wherein the first inlet 111 and the first outlet 112 are fluidically coupled via the first chamber 121. That is, in the second configuration, a first fluidic path P1 is defined from the first inlet 111 to the first outlet 112 through the first chamber 121.

In this example, the fluidic device 10 is arranged to move from the first configuration to the second configuration by the first inlet 111 and the first outlet 112 perforating through the first wall portion 122 into the first chamber 121, thereby providing a first inlet passageway 113 and a first outlet passageway 114 from the first part 110 into the first chamber 121 of the second part 120. In this example, the first inlet passageway 113 and the first outlet passageway 114 are mutually spaced apart by the spacing S1.

In the second configuration, increasing the first pressure P1 in the first chamber 121 via the first inlet 111 urges at least a part of the predetermined first amount A1 of the first fluid F1 through the first outlet 112. Hence, by increasing the first pressure P1 in the first chamber 121 via the first inlet 111, for example by introducing a gas or a liquid into the first chamber 121 through the first inlet 111, at least the part of the predetermined first amount A1 of the first fluid F1 is urged (i.e. driven or pumped) through the first outlet 112 in turn, as described above.

In this example, the first inlet 111 and the first outlet 112 comprise respective perforation members 115, 116 arranged to perforate through the first wall portion 122. In this example, the first wall portion 122 is a perforatable (also known as a pierceable) wall portion.

In this example, the first part 110 comprises a planar surface 117, arranged to confront and/or contact the first wall portion 122 and the first inlet 111 and the first outlet 112 extend away from the surface 117. In this example, a length L1 of the first inlet 111 extending away from the surface is equal to a length L2 of the first outlet 112 extending away from the surface. In this example, respective locations of the first inlet 111 and the first outlet 112 correspond with a location of the first chamber 121.

In this example, the first wall portion 122 is arranged to fluidically seal around the first inlet 111 and the first outlet 112 in the second configuration. In this way, by increasing the first pressure P1 in the first chamber 121 via the first inlet 111, the part of the predetermined first amount A1 of the first fluid F1 is constrained to be urged through the first outlet 112, rather than leak or seep, for example, via another fluid flow path.

In this example, the fluidic device 10 comprises a first coupling member 130 (130A, 130B) arranged to interlock the first part 110 and the second part 120 in the second configuration. In this way, the first part 110 and the second part 120 may be held securely together in the second configuration. In this example, the first coupling member 130 (130A, 130B) comprises a latch 131 (131A, 131B) arranged to fasten through an aperture 132 (132A, 132B) in the second part 120. In this example, the fluidic device 10 comprises two (i.e. a plurality) of such first coupling members 130 (130A, 130B).

In this example, the fluidic device 10 comprises a second coupling member 140, particularly a hinge 140, arranged to moveably, particularly rotatably, couple the first part 110 and the second part 120 in the first configuration and the second configuration. The hinge 140 is provided by a portion of the fluidic device 10 having a reduced thickness. In this way, the first part 110 and the second part 120 may be provided together and to guide movement of the fluidic device 10 from the first configuration to the second configuration, for example to control locations of the first wall portion 122 through which the first inlet 111 and the first outlet 112 perforate.

In this example, the first part 110 comprises a second inlet 211, fluidically coupled to the first outlet 112 via a channel 119, and a second outlet 212, mutually spaced apart. The second part 120 comprises a second chamber 221 arranged to contain a predetermined second amount A2 of a second fluid F2 therein and a second wall portion 222 arranged to contain, at least in part, the predetermined second amount A2 of the second fluid F2 in the second chamber 221. The first part 110 is fluidically isolated from the second chamber 221 in the first configuration. The second inlet 211 and the second outlet 212 are fluidically coupled via the second chamber, in the second configuration, whereby increasing the first pressure P1 in the first chamber 121 via the first inlet 111 urges at least a part of the predetermined second amount A2 of the second fluid F2 through the second outlet 212. The fluidic device 10 is arranged to move from the first configuration to the second configuration by the second inlet 211 and the second outlet 212 perforating through the second wall portion 222 into the second chamber 221.

The second inlet 211, the second outlet 212, the second chamber 221, the predetermined second amount A2 of the second fluid F2, the second fluid F2 and the second wall portion 222 are as described herein with respect to the first inlet 111, the first outlet 112, the first chamber 121, the predetermined first amount A1 of the first fluid F1, the first fluid F1 and the first wall portion 122, respectively.

In this example, the second inlet 211 and the second outlet 212 comprise respective perforation members 215, 216 arranged to perforate through the second wall portion 222. In this example, the second wall portion 222 is a perforatable (also known as a pierceable) wall portion.

In this example, the second part 210 comprises the planar surface 117, arranged to confront and/or contact the second wall portion 222 and the second inlet 211 and the second outlet 212 extend away from the surface 117. In this example, a length L3 of the second inlet 211 extending away from the surface is equal to a length L4 of the second outlet 212 extending away from the surface. In this example, respective locations of the second inlet 211 and the second outlet 212 correspond with a location of the second chamber 221.

In this example, the second wall portion 222 is arranged to fluidically seal around the second inlet 211 and the second outlet 212 in the second configuration. In this way, by increasing the second pressure P2 in the second chamber 221 via the second inlet 211, the part of the predetermined second amount A2 of the second fluid F2 is constrained to be urged through the second outlet 212, rather than leak or seep, for example, via another fluid flow path.

In this example, the fluidic device 10 is arranged to move from the first configuration to the second configuration by the second inlet 211 and the second outlet 212 perforating through the second wall portion 222 into the second chamber 221, thereby providing a second inlet passageway 213 and a second outlet passageway 214 from the first part 210 into the second chamber 221 of the second part 220. In this example, the second inlet passageway 213 and the second outlet passageway 214 are mutually spaced apart by the spacing S2.

Hence, the first chamber 121 and the second chamber 221 are mutually fluidically isolated in the first configuration and the first chamber 121 and the second chamber 221 are fluidically coupled in the second configuration. That is, in the second configuration, a first fluidic path is defined from the first inlet 111 to the second outlet 212 via (i.e. through) the first chamber 121, the second inlet 211 and the second chamber 221. Hence, by increasing the first pressure P1 in the first chamber 121 via the first inlet 111, the part of the predetermined first amount A1 of the first fluid F1 is urged through the first outlet 112 and hence through the second inlet 211 into the second chamber 221, thereby increasing a second pressure P2 in the second chamber 221 and urging at least the part of the predetermined second amount A2 of the second fluid F2 through the second outlet 212. In other words, in the second configuration, the first chamber 121 and the second chamber 221 are daisy-chained.

In this example, the first inlet 111 is fluidically coupleable to a gas source, whereby gas provided by the gas source increases the first pressure P1 in the first chamber 121.

In this example, the fluidic device 10 is a microfluidic device 10. In this example, the fluidic device 10 comprises the first fluid F1 and the second fluid F2. In this example the first fluid F1 is a liquid and the second fluid F2 is a liquid.

FIG. 22 schematically depicts a second part 920 of a fluidic device 900 in the second configuration, in use, according to an exemplary embodiment. Particularly, FIG. 22 schematically depicts a plan view of the second part 920.

The second part 920 comprises a first chamber 921 arranged to contain a predetermined first amount A1 of a first fluid F1 therein and a first wall portion 922 arranged to contain, at least in part, the first fluid F1 in the first chamber 921. The first chamber 921 comprises three circular antechambers, a first inlet antichamber 9211, a first outlet antechamber 9212A and a second outlet antechamber 9212B, circular second wall portions 923 of which extend around about 330° thereof (i.e. surrounding almost completely, with a relatively narrow passageway connecting to the main part of the first chamber 921), thereby providing improved structural support to the first wall portion 922 during perforation thereof. Particularly, these antechambers 9211, 9212A and 9212B are arranged to correspond with a first inlet 911, a first outlet 912A and a second outlet 912B respectively of a corresponding first part 910 (not shown) of the fluidic device 900. The fluidic device 900 is arranged vertically. In use, the first inlet antichamber 9211 and the first outlet antechamber 9212A are arranged at a lowermost side of the first chamber 921 and the second outlet antechamber 9212B is arranged proximal an opposed uppermost side of the first chamber 921.

The predetermined first amount A1 of the first fluid F1 partially fills the first chamber 921. In use, the fluidic device is moved from the first configuration to the second configuration by the by the first inlet 911, the first outlet 912A and the second outlet 912B perforating through the first wall portion 922 into the antechambers 9211, 9212A and 9212B respectively of the first chamber 921. Initially, the first inlet 911, the first outlet 912A and the second outlet 912B are closed, for example using respective valves. The first inlet 911 and the second outlet 912B are opened. With the first outlet 912A closed and the second outlet 912B open, gas is introduced into the first chamber 921 via the open first inlet 911 to mix the predetermined first amount A1 of the first fluid F1. This gas exits the first chamber 921 via the second outlet 912B, which is open. The second outlet 912B is closed and the first outlet 912A is opened. Gas introduced into the first chamber 921 via the first inlet 911 is pressurised in the first chamber 921 above the predetermined first amount A1 of the first fluid F1, because the second outlet 912B is closed, and urges the predetermined first amount A1 of the first fluid F1 exit the first chamber 921 via the first outlet 911B, which is open. Since the first inlet antichamber 9211 and the first outlet antechamber 9212A are arranged at the lowermost side of the first chamber 921, substantially all of the predetermined first amount A1 of the first fluid F1 may be pumped out of the first chamber 921 via the first outlet antechamber 9212A. In this way, by controlling the opening and closing of the first outlet 912A and the second outlet 912B and the introduction of gas, the predetermined first amount A1 of the first fluid F1 may be mixed in situ using the gas before being pumped out of the first chamber 921 using the gas.

Figure 5:
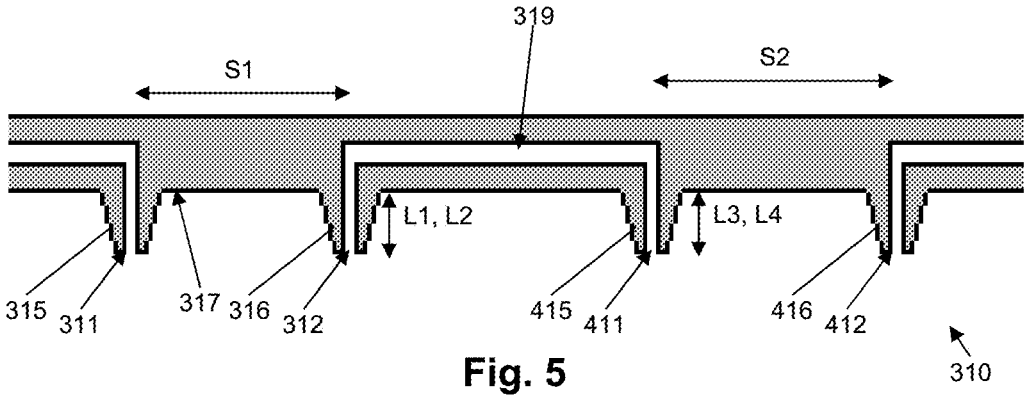
FIG. 5 schematically depicts a first part of a fluidic device in a first configuration according to an exemplary embodiment.
Figure 6:
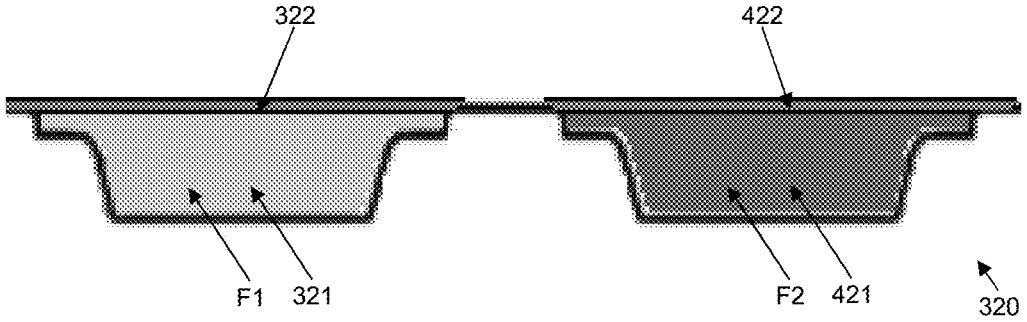
FIG. 6 schematically depicts a second part of the fluidic device of FIG. 5 in the first configuration according to an exemplary embodiment.
Figure 7:
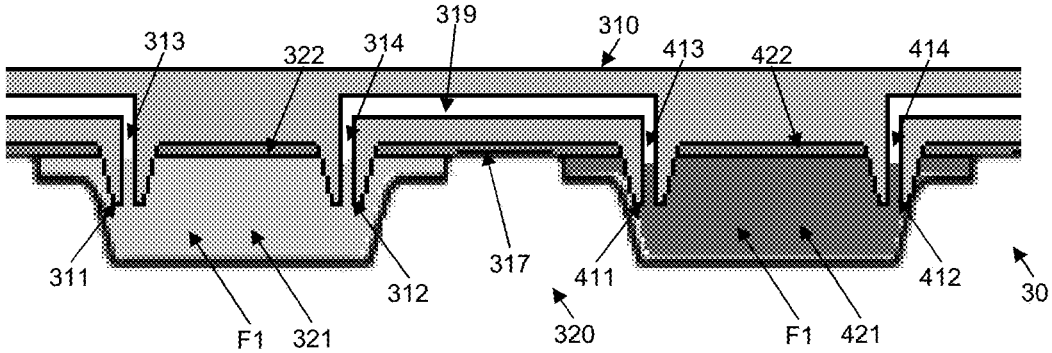
FIG. 7 schematically depicts the fluidic device of FIGS. 5 and 6 in a second configuration according to an exemplary embodiment.
Figure 8:
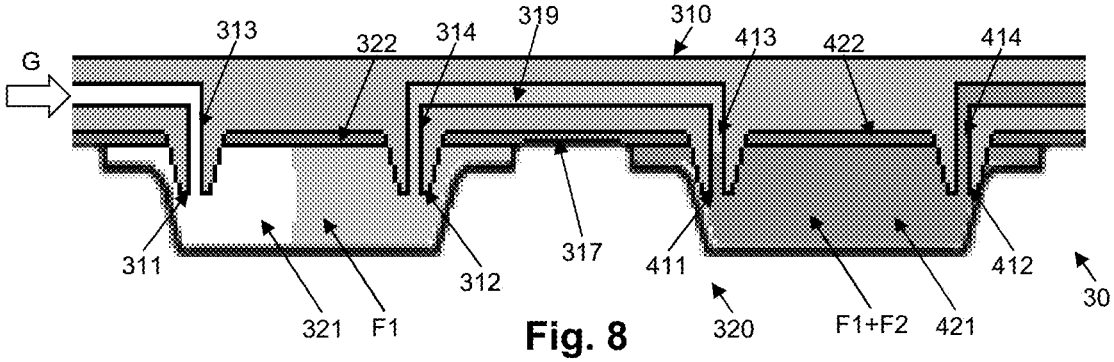
FIG. 8 schematically depicts the fluidic device of FIG. 7 in the second configuration, in use.

FIGS. 5 and 6 schematically depict a fluid device 30 according to an exemplary embodiment in a first configuration and FIGS. 7 and 8 schematically depict the fluidic device 30 in a second configuration.

FIG. 5 schematically depicts the first part 310 of the fluidic device 30 in the first configuration according to an exemplary embodiment. Particularly, FIG. 5 is a longitudinal cross-sectional view of the first part 310 of the fluidic device 30 in the first configuration, as described below in more detail.

FIG. 6 schematically depicts the second part 320 of the fluidic device 30 of FIG. 5 in the first configuration according to an exemplary embodiment. Particularly, FIG. 6 is a longitudinal cross-sectional view of the second part 320 of the fluidic device 30 in the first configuration, as described below in more detail.

FIG. 7 schematically depicts the fluidic device 30 of FIGS. 5 and 6 in the second configuration according to an exemplary embodiment. Particularly, FIG. 7 is a longitudinal cross-sectional view of the fluidic device 30 in the second configuration.

FIG. 8 schematically depicts the fluidic device 30 of FIG. 7 in the second configuration, in use. Particularly, FIG. 8 is a longitudinal cross-sectional view of the fluidic device 30 in the second configuration.

In more detail, the fluidic device 30 comprises the first part 310 and the second part 320. The first part 310 comprises a first inlet 311 and a first outlet 312, mutually spaced apart. The second part 320 comprises a first chamber 321 arranged to contain a predetermined first amount A1 of a first fluid F1 therein and a first wall portion 322 arranged to contain, at least in part, the first fluid F1 in the first chamber 321. The fluidic device 30 is arrangeable in a first configuration, wherein the first part 310 is fluidically isolated from the first chamber 321. The fluidic device 30 is arrangeable in a second configuration, wherein the first inlet 311 and the first outlet 312 are fluidically coupled via the first chamber 321, whereby increasing a first pressure P1 in the first chamber 321 via the first inlet 311 urges at least a part of the predetermined first amount A1 of the first fluid F1 through the first outlet 312. The fluidic device 30 is arranged to move from the first configuration to the second configuration by the first inlet 311 and the first outlet 312 perforating through the first wall portion 322 into the first chamber 321.

The fluidic device 30 comprises the first part 310 and the second part 320. In this example, the first part 310 comprises and/or is a LOC device and the second part 320 contains a reagent for the LOC device i.e. the predetermined first amount A1 of the first fluid F1 in the first chamber 321 is the reagent for the LOC device. In this example, the first part 310 and the second part 320 are respective parts of a single device, particularly the fluidic device 30. In this example, the first part 310 and the second part 320 are integrally formed.

In this example, the first inlet 311 and the first outlet 312 are mutually spaced apart by a first spacing S1.

In this example, the first chamber 321 comprises no internal corners or dead volumes. In this way, up to all of the predetermined first amount A1 of the first fluid F1 may be urged through the first outlet 312.

It should be understood that in the first configuration, the first fluid F1 is isolated in the first chamber 321, for example sealed therein, such as required for storage. That is, the first wall portion 322 and remaining walls (i.e. a second wall portion 223) of the first chamber 321 define a closed chamber (also known as a closed container) in the first configuration. In this example, the first chamber 321 is a closed chamber wherein the first wall portion 321 is arranged to close the first chamber 321. In this example, the first wall portion 322 is arranged to sealingly contain, at least in part, the first fluid F1 in the first chamber 321 in the first configuration, for example by being sealed around a periphery of the first chamber 321. In this example, the first wall portion 322 foil comprises a foil, comprising one or more layers. In this example, the first wall portion 322 comprises no perforations therethrough in the first configuration. In this example, the first chamber 321 comprises no perforations therethrough in the first configuration. In this example, the first wall portion 322 is a perforatable (also known as a pierceable) wall portion. In this example, the first wall portion 322 comprises a first layer coupled to a first edge 323 of the first chamber 321.

In this example, the second part 320 is formed, at least in part, from a sheet material and wherein the first chamber 321 comprises a concavity formed therein.

The fluidic device 30 is arrangeable in the second configuration, wherein the first inlet 311 and the first outlet 312 are fluidically coupled via the first chamber 321. That is, in the second configuration, a first fluidic path P1 is defined from the first inlet 311 to the first outlet 312 through the first chamber 321.

In this example, the fluidic device 30 is arranged to move from the first configuration to the second configuration by the first inlet 311 and the first outlet 312 perforating through the first wall portion 322 into the first chamber 321, thereby providing a first inlet passageway 313 and a first outlet passageway 314 from the first part 310 into the first chamber 321 of the second part 320. In this example, the first inlet passageway 313 and the first outlet passageway 314 are mutually spaced apart by the spacing S1.

In the second configuration, increasing the first pressure P1 in the first chamber 321 via the first inlet 311 urges at least a part of the predetermined first amount A1 of the first fluid F1 through the first outlet 312. Hence, by increasing the first pressure P1 in the first chamber 321 via the first inlet 311, for example by introducing a gas or a liquid into the first chamber 321 through the first inlet 311, at least the part of the predetermined first amount A1 of the first fluid F1 is urged (i.e. driven or pumped) through the first outlet 312 in turn, as described above.

In this example, the first inlet 311 and the first outlet 312 comprise respective perforation members 315, 316 arranged to perforate through the first wall portion 322. In this example, the first wall portion 322 is a perforatable (also known as a pierceable) wall portion.

In this example, the first part 310 comprises a planar surface 317, arranged to confront and/or contact the first wall portion 322 and the first inlet 311 and the first outlet 312 extend away from the surface 317. In this example, a length L1 of the first inlet 311 extending away from the surface is equal to a length L2 of the first outlet 312 extending away from the surface. In this example, respective locations of the first inlet 311 and the first outlet 312 correspond with a location of the first chamber 321.

In this example, the first wall portion 322 is arranged to fluidically seal around the first inlet 311 and the first outlet 312 in the second configuration. In this way, by increasing the first pressure P1 in the first chamber 321 via the first inlet 311, the part of the predetermined first amount A1 of the first fluid F1 is constrained to be urged through the first outlet 312, rather than leak or seep, for example, via another fluid flow path.

In this example, the first part 310 comprises a second inlet 411, fluidically coupled to the first outlet 312 via a channel 319, and a second outlet 412, mutually spaced apart. The second part 320 comprises a second chamber 421 arranged to contain a predetermined second amount A2 of a second fluid F2 therein and a second wall portion 422 arranged to contain, at least in part, the predetermined second amount A2 of the second fluid F2 in the second chamber 421. The first part 310 is fluidically isolated from the second chamber 421 in the first configuration. The second inlet 411 and the second outlet 412 are fluidically coupled via the second chamber 421, in the second configuration, whereby increasing the first pressure P1 in the first chamber 321 via the first inlet 311 urges at least a part of the predetermined second amount A2 of the second fluid F2 through the second outlet 412. In this example, the fluidic device 30 is arranged to move from the first configuration to the second configuration by the second inlet 411 and the second outlet 412 perforating through the second wall portion 422 into the second chamber 421.

The second inlet 411, the second outlet 412, the second chamber 421, the predetermined second amount A2 of the second fluid F2, the second fluid F2 and the second wall portion 422 are as described herein with respect to the first inlet 311, the first outlet 312, the first chamber 321, the predetermined first amount A1 of the first fluid F1, the first fluid F1 and the first wall portion 322, respectively.

That is, the first chamber 321 and the second chamber 421 are mutually fluidically isolated in the first configuration and the first chamber 321 and the second chamber 421 are fluidically coupled in the second configuration. That is, in the second configuration, a first fluidic path is defined from the first inlet 311 to the second outlet 412 via (i.e. through) the first chamber 321, the first outlet 312, the second inlet 411 and the second chamber 421.

In this example, the second inlet 411 and the second outlet 412 comprise respective perforation members 415, 416 arranged to perforate through the second wall portion 422. In this example, the second wall portion 422 is a perforatable (also known as a pierceable) wall portion.

In this example, the second part 310 comprises the planar surface 317, arranged to confront and/or contact the second wall portion 422 and the second inlet 411 and the second outlet 412 extend away from the surface 317. In this example, a length L3 of the second inlet 411 extending away from the surface is equal to a length L4 of the second outlet 412 extending away from the surface. In this example, respective locations of the second inlet 411 and the second outlet 412 correspond with a location of the second chamber 421.

In this example, the second wall portion 422 is arranged to fluidically seal around the second inlet 411 and the second outlet 412 in the second configuration. In this way, by increasing the second pressure P2 in the second chamber 421 via the second inlet 411, the part of the predetermined second amount A2 of the second fluid F2 is constrained to be urged through the second outlet 412, rather than leak or seep, for example, via another fluid flow path.

In this example, the fluidic device 10 is arranged to move from the second configuration to the second configuration by the second inlet 411 and the second outlet 412 perforating through the second wall portion 422 into the second chamber 421, thereby providing a second inlet passageway 413 and a second outlet passageway 414 from the first part 310 into the second chamber 421 of the second part 320. In this example, the second inlet passageway 413 and the second outlet passageway 414 are mutually spaced apart by the spacing S2.

Hence, the first chamber 321 and the second chamber 421 are mutually fluidically isolated in the first configuration and the first chamber 321 and the second chamber 421 are fluidically coupled in the second configuration. That is, in the second configuration, a first fluidic path is defined from the first inlet 311 to the second outlet 412 via (i.e. through) the first chamber 321, the second inlet 411 and the second chamber 421. Hence, by increasing the first pressure P1 in the first chamber 321 via the first inlet 311, the part of the predetermined first amount A1 of the first fluid F1 is urged through the first outlet 312 and hence through the second inlet 411 into the second chamber 421, thereby increasing a second pressure P2 in the second chamber 421 and urging at least the part of the predetermined second amount A2 of the second fluid F2 through the second outlet 412. In other words, in the second configuration, the first chamber 321 and the second chamber 421 are daisy-chained.

In this example, the first inlet 311 is fluidically coupleable to a gas source, whereby gas G provided by the gas source increases the first pressure P1 in the first chamber 321.

In this example, the fluidic device 30 is a microfluidic device 30. In this example, the fluidic device 30 comprises the first fluid F1 and the second fluid F2. In this example the first fluid F1 is a liquid and the second fluid F2 is a liquid.

As shown in FIG. 7, the fluidic device 30 is moved from the first configuration to the second configuration by the first inlet 311 and the first outlet 312 perforating through the first wall portion 322 into the first chamber 321. In the second configuration, the first inlet 311 and the first outlet 312 are fluidically coupled via the first chamber 321. The fluidic device 30 is moved from the first configuration to the second configuration by the second inlet 411 and the second outlet 412 perforating through the second wall portion 422 into the second chamber 421. In the second configuration, the second inlet 411 and the second outlet 412 are fluidically coupled via the first chamber 321.

As shown in FIG. 8, by increasing the first pressure P1 in the first chamber 321 via the first inlet 311, the part of the predetermined first amount A1 of the first fluid F1 is urged through the first outlet 312 and hence through the second inlet 411 into the second chamber 421, thereby increasing a second pressure P2 in the second chamber 421 and urging at least the part of the predetermined second amount A2 of the second fluid F2 through the second outlet 412. The first fluid F1 mixes with the second fluid F2 in the second chamber 421. In other words, in the second configuration, the first chamber 321 and the second chamber 421 are daisy-chained.

Figure 9A:
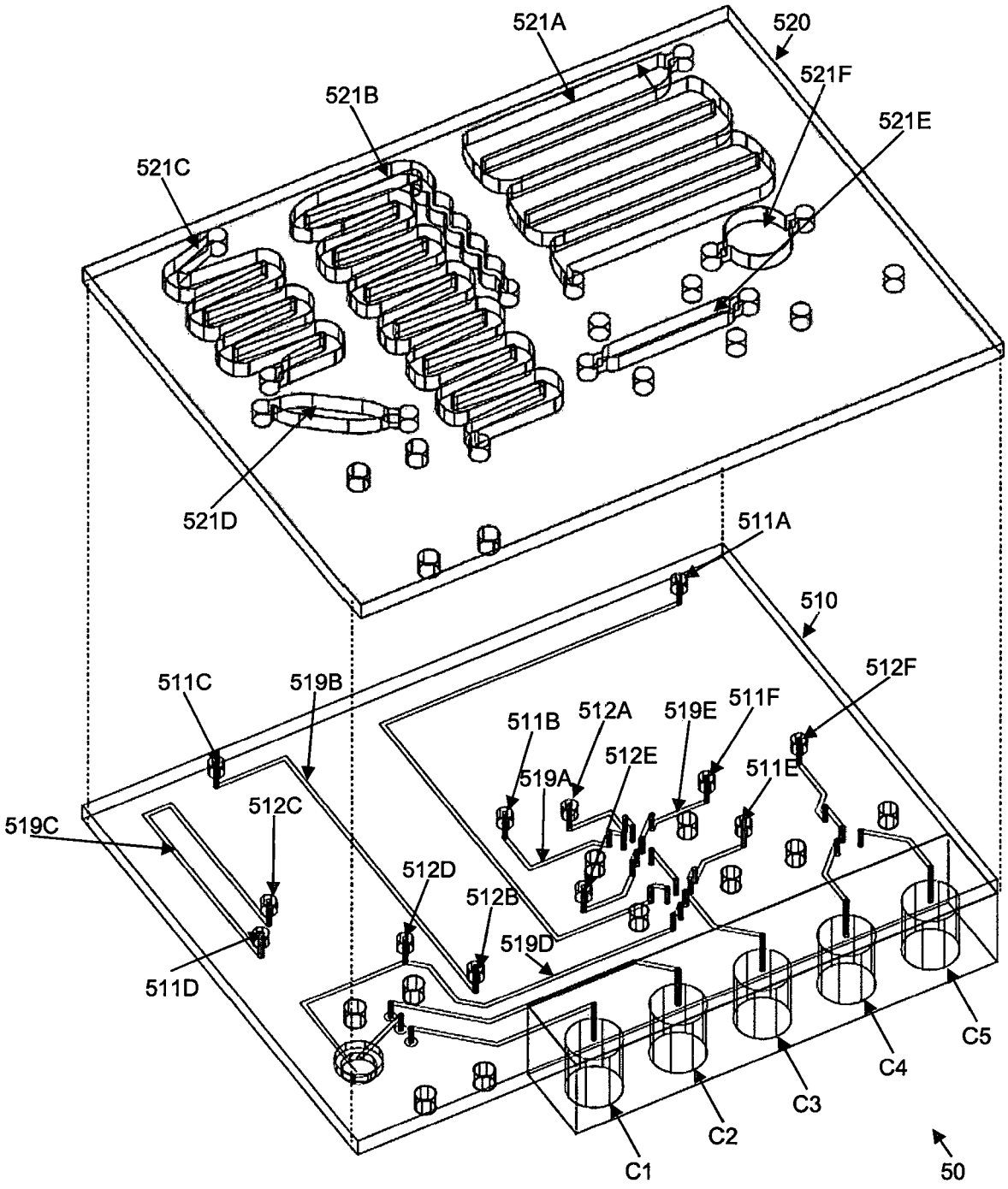
FIG. 9A schematically depicts a fluidic device in a first configuration according to an exemplary embodiment and FIG. 9B schematically depicts the fluidic device in a second configuration.
Figure 9B:
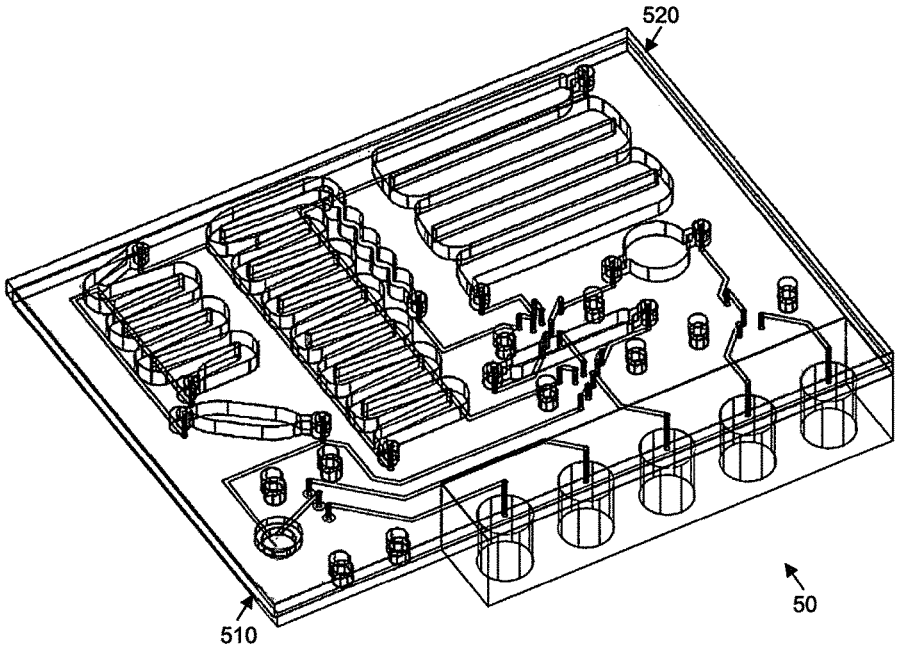

FIG. 9A schematically depicts a fluidic device 50 in a first configuration according to an exemplary embodiment and FIG. 9B schematically depicts the fluidic device 50 in a second configuration. Particularly, FIG. 9A is a transparent projectional view of the fluidic device 50 and FIG. 9B is a transparent projectional view of the fluidic device 50.

In more detail, the fluidic device 50 comprises a first part 510 and a second part 520. The first part 510 comprises a first inlet 511A and a first outlet 512A, mutually spaced apart. The second part 520 comprises a first chamber 521A arranged to contain a predetermined first amount A1 of a first fluid F1 therein and a first wall portion 522 arranged to contain, at least in part, the first fluid F1 in the first chamber 521A. The fluidic device 50 is arrangeable in a first configuration, wherein the first part 510 is fluidically isolated from the first chamber 521A. The fluidic device 50 is arrangeable in a second configuration, wherein the first inlet 511A and the first outlet 512A are fluidically coupled via the first chamber 521A, whereby increasing a first pressure P1 in the first chamber 521A via the first inlet 511A urges at least a part of the predetermined first amount A1 of the first fluid F1 through the first outlet 512A. In this example, the fluidic device 50 is arranged to move from the first configuration to the second configuration by the first inlet 511A and the first outlet 512A perforating through the first wall portion 522 into the first chamber 521A.

In this example, the first part 510 comprises six inlets 511 (511A-511F) and six outlets 512 (512A-512F) corresponding with six chambers 521 (521A-521F) in the corresponding second part 520. The five outlets 511A-511E are fluidically coupled to the five inlets 512B-512F via conduits 519 (519A-519E) respectively.

In the second configuration, increasing the first pressure P1 in the first chamber 521A via the first inlet 511A urges at least a part of the predetermined first amount A1 of the first fluid F1 through the first outlet 512A. Hence, by increasing the first pressure P1 in the first chamber 521A via the first inlet 511, for example by introducing a gas or a liquid into the first chamber 521A through the first inlet 511A, at least the part of the predetermined first amount A1 of the first fluid F1 is urged (i.e. driven or pumped) through the first outlet 512A in turn, as described above. Furthermore, since the five outlets 511A-511E are fluidically coupled to the five inlets 512B-512F via conduits 519 (519A-519E) respectively, increasing the first pressure P1 in the first chamber 521A and thereby urging at least the part of the predetermined first amount A1 of the first fluid F1 through the first outlet 512A, respective pressures P2-P6 in the daisy-chained chambers 521B-521F are in turn increased as fluids are urged therebetween.

In this example, the chamber 521A has a boustrophedonic (i.e. a zig-zag, alternately left to right then right to left, a serpentine) shape, the chamber 521B has a boustrophedonic shape, the chamber 521C has a boustrophedonic shape, the chamber 521D has a cigar shape, the chamber 521D has a cigar shape, the chamber 521E has a drum shape.

In this example, the first part 510 comprises five (5) standard female ¼"-28 connectors C1-C5.

Figure 10:
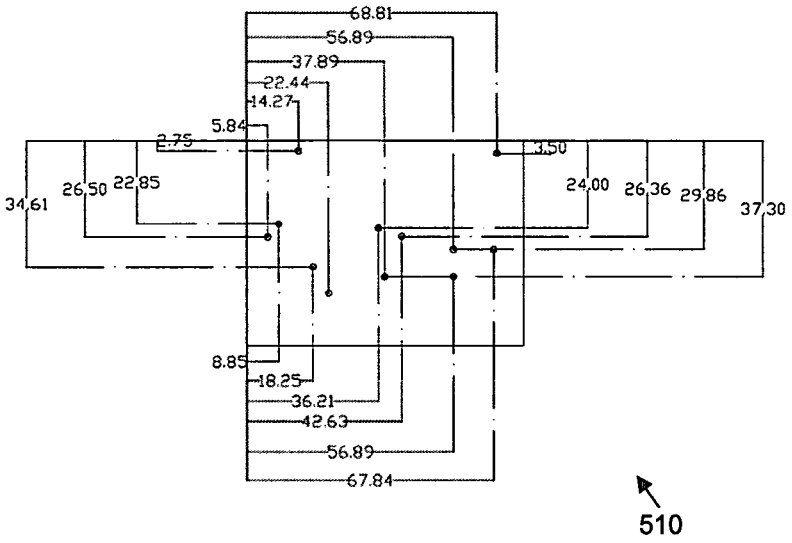
FIG. 10 schematically depicts the first part of the fluidic device of FIG. 9A and FIG. 9B, in more detail.

FIG. 10 schematically depicts the first part 510 of the fluidic device 50 of FIG. 9A and FIG. 9B, in more detail. Particularly, FIG. 10 is a plan view of the first part 510, showing locations of the inlets 511 and the outlets 512.

In this example, respective locations of the inlets 511 and the outlets 512 correspond with respective locations of six chambers 521 in the corresponding second part 520. In this example, the respective locations of the inlets 511 and the outlets 512 are predetermined accurately and precisely, according to manufacture of the first part 510. In this way, respective locations of perforation of the corresponding chambers in the second part 520 may be similarly determined accurately and precisely, thereby improving the accuracy and/or the precision of the amount of the fluid expelled from the chambers.

Figure 11:
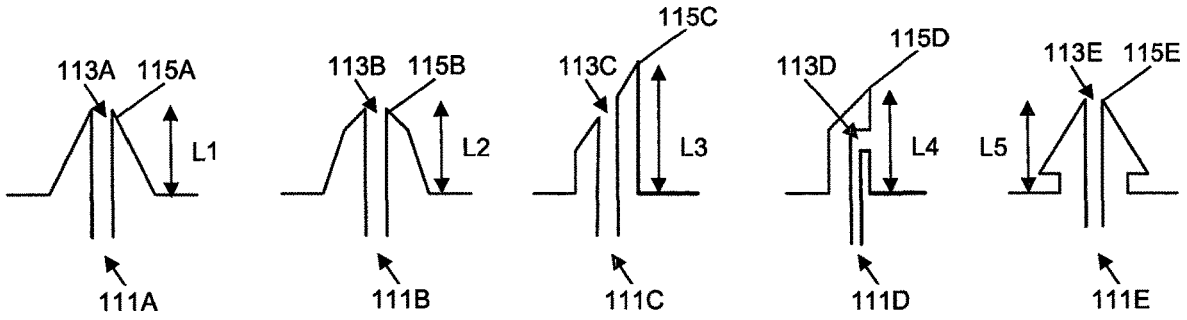
FIG. 11 schematically depicts a first part of a fluidic device according to an exemplary embodiment, in more detail.

FIG. 11 schematically depicts a first part of a fluidic device according to an exemplary embodiment, in more detail. Particularly, FIG. 11 shows cross-sectional views of five (5) alternative first inlets 111A-111E and/or first outlets 112A-112E of the first part of the fluidic device.

The first inlet 111A comprises a perforation member 115A, particularly a conical needle having an axial first inlet passageway 113A therethrough and an open tip, arranged to perforate through the first wall portion. The first inlet 111A is arranged to extend away from a planar surface of the first part. The first inlet 111A has a length L1 of 1.5 mm.

The first inlet 111B comprises a perforation member 115B, particularly a conical needle, having and an open tip and a tip portion of a relatively larger cone angle, having an axial first inlet passageway 113B therethrough, arranged to perforate through the first wall portion. The first inlet 111B is arranged to extend away from a planar surface of the first part. The first inlet 111B has a length L1 of 1.5 mm.

The first inlet 111C comprises a perforation member 115C, particularly a single bevel needle having an axial first inlet passageway 113C therethrough and an open tip, arranged to perforate through the first wall portion. The first inlet 111C is arranged to extend away from a planar surface of the first part. The first inlet 111C has a length L1 of 1.5 mm.

The first inlet 111D comprises a perforation member 115D, particularly a single bevel needle having a first inlet passageway 113D therethrough and a closed tip, wherein the first inlet passageway exits via a side wall of the needle, arranged to perforate through the first wall portion. The first inlet 111D is arranged to extend away from a planar surface of the first part. The first inlet 111D has a length L4 of 1.5 mm.

The first inlet 111E comprises a perforation member 115E, particularly a conical needle having an axial first inlet passageway 113E therethrough and an open tip, wherein a base of the needle comprise a groove arranged to receive a sealing member, arranged to perforate through the first wall portion. The first inlet 111E is arranged to extend away from a planar surface of the first part. The first inlet 111E has a length L5 of 1.5 mm.

Figure 12:
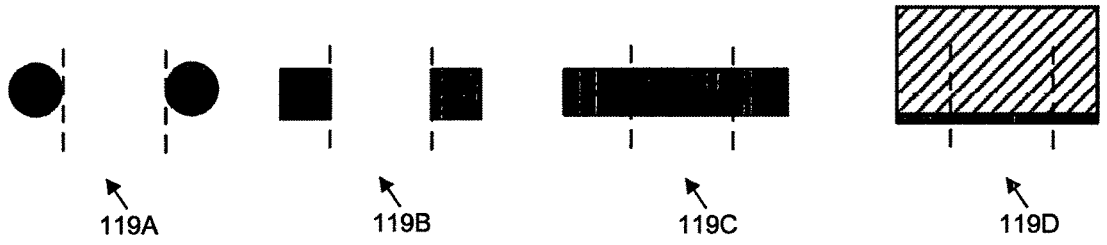
FIG. 12 schematically depicts a first part of a fluidic device according to an exemplary embodiment, in more detail.

FIG. 12 schematically depicts a first part of a fluidic device according to an exemplary embodiment, in more detail. Particularly, FIG. 12 shows cross-sectional views of four (4) alternative sealing members 119A-119D for the inlet and/or the outlet of the first part of the fluidic device, for example for the first inlet 111E described above.

The sealing member 119A is an O-ring. The sealing member 119B is a flat gasket. The sealing member 119C is a pierceable gasket sheet. The sealing member 119D is a layer provided on the first wall portion, which acts as a septa membrane.

Figure 13:
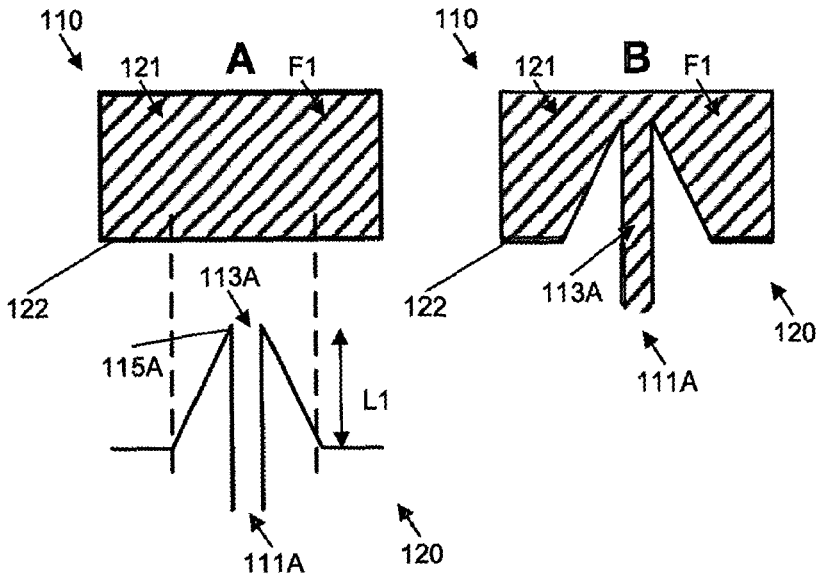
FIGS. 13A and 13B schematically depict moving the fluidic device of FIGS. 1 to 4 from the first configuration to the second configuration, respectively.

FIGS. 13A and 13B schematically depict moving the fluidic device 10 of FIGS. 1 to 4 from the first configuration to the second configuration, respectively. In this example, the first inlet 111A is as described with respect to FIG. 11. The fluidic device 10 is arranged to move from the first configuration to the second configuration by the first inlet 111A perforating through the first wall portion 122 into the first chamber 121. In this example, the first wall portion 122 is arranged to fluidically seal around the first inlet 111A.

Figure 14:
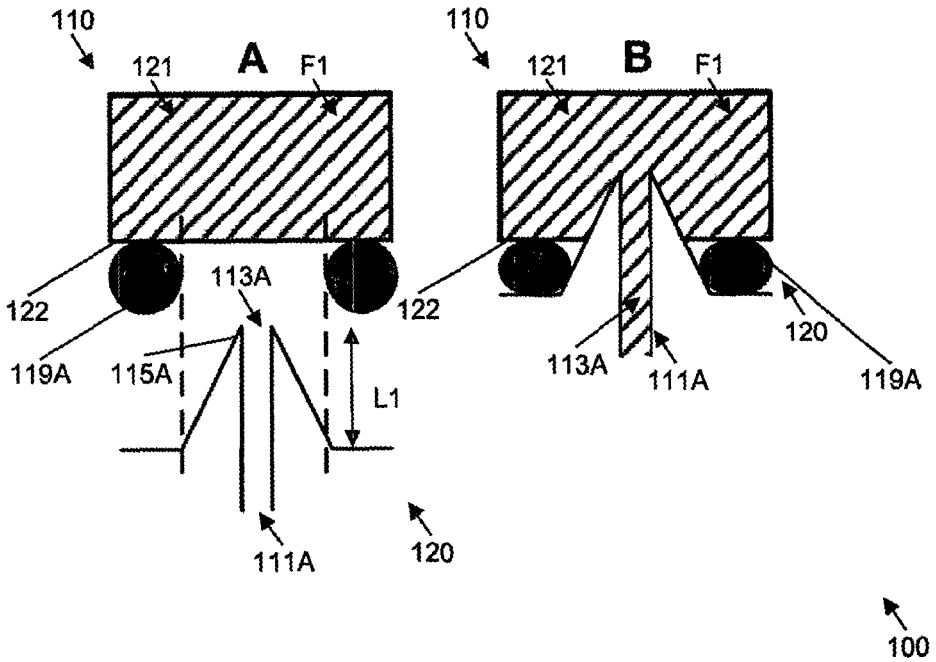
FIGS. 14A and 14B schematically depict moving the fluidic device of FIGS. 1 to 4 from the first configuration to the second configuration, respectively.

FIGS. 14A and 14B schematically depict moving the fluidic device 10 of FIGS. 1 to 4 from the first configuration to the second configuration, respectively. In this example, the first inlet 111A is as described above with respect to FIG. 11. In this example, the fluidic device 10 comprises the sealing member 119A, as described with respect to FIG. 12. The fluidic device 10 is arranged to move from the first configuration to the second configuration by the first inlet 111A perforating through the first wall portion 122 into the first chamber 121. In this example, the sealing member 119A is arranged around the first inlet 111A to provide a fluidic seal between the first wall portion 122 and the first inlet 111A, by compression of the sealing member 119A as shown in FIG. 14B.

Figure 15:
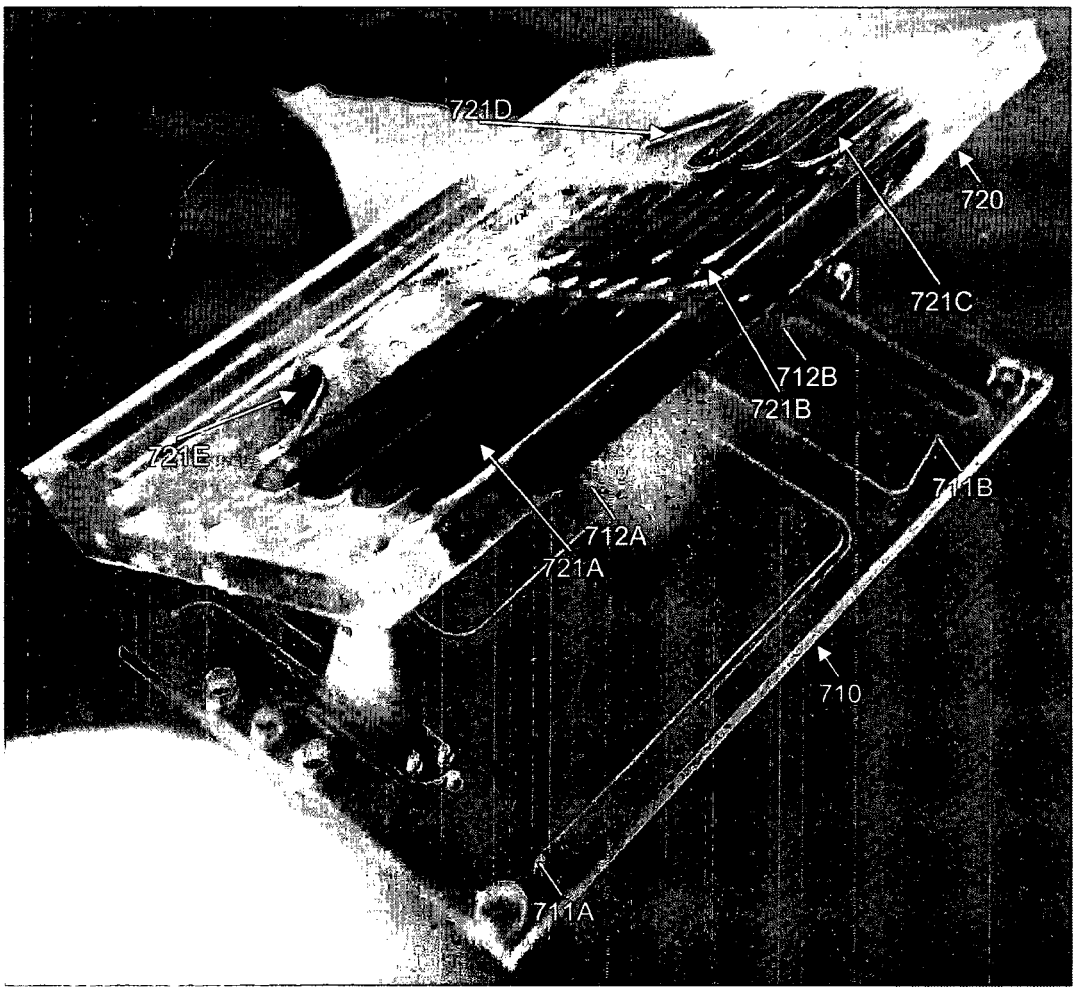
FIG. 15 schematically depicts a fluidic device in a first configuration according to an exemplary embodiment.

FIG. 15 schematically depicts a fluidic device 70 in a first configuration according to an exemplary embodiment. Particularly, FIG. 15 shows a photograph of the fluidic device 70.

In more detail, the fluidic device 70 comprises the first part 710 and the second part 720. The first part 710 comprises a first inlet 711A and a first outlet 712A, mutually spaced apart. The second part 720 comprises a first chamber 721A arranged to contain a predetermined first amount A1 of a first fluid F1 therein and a first wall portion 722A arranged to contain, at least in part, the first fluid F1 in the first chamber 722A. The fluidic device 70 is arrangeable in a first configuration, wherein the first part 710 is fluidically isolated from the first chamber 721A. The fluidic device 70 is arrangeable in a second configuration, wherein the first inlet 711A and the first outlet 712A are fluidically coupled via the first chamber 721A, whereby increasing a first pressure P1 in the first chamber 721A via the first inlet 711A urges at least a part of the predetermined first amount A1 of the first fluid F1 through the first outlet 712A. The fluidic device 70 is arranged to move from the first configuration to the second configuration by the first inlet 711A and the first outlet 712A perforating through the first wall portion 722A into the first chamber 721A.

In this example, the second part 720 comprises five (5) chambers 721A-721E containing respectively predetermined amounts A1-A5 of fluids F1-F5 therein and wall portions 722A-722E (not shown) arranged to contain, at least in part, the fluid F1-F5 in the respective chambers 720A-720E. In this example, the first part 710 comprises five (5) inlets 711A-711E and five outlets 712A-712E (not all shown), corresponding to the five (5) chambers 721A-721E.

Figure 16:
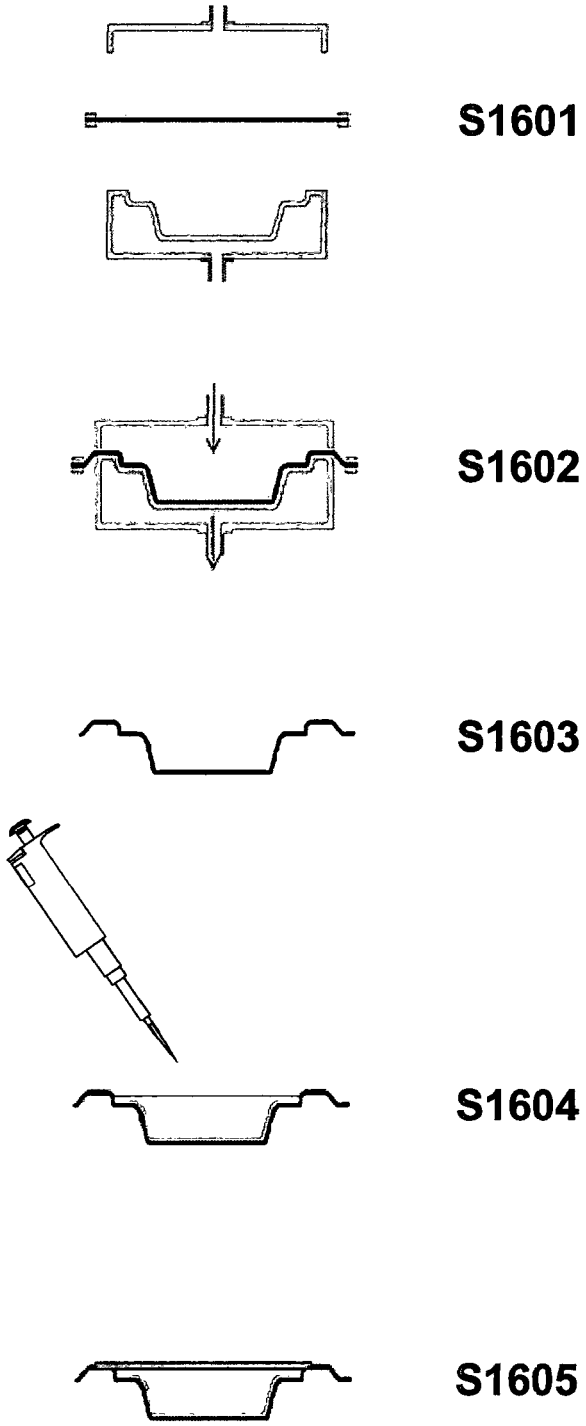
FIG. 16 schematically depicts a method of manufacturing a second part of a fluidic device according to an exemplary embodiment.

FIG. 16 schematically depicts a method of manufacturing a second part of a fluidic device according to an exemplary embodiment.

At S1601, a sheet of a material comprising a polymeric composition comprising a thermoplastic polymer is provided.

At S1602, the sheet is thermoformed.

At S1603, a first chamber of the second part is provided by thermoforming.

At S1604, a predetermined first amount of a first fluid is dispensed into the first chamber.

At S1605, a first wall portion is sealed across the first chamber.

Figure 17:
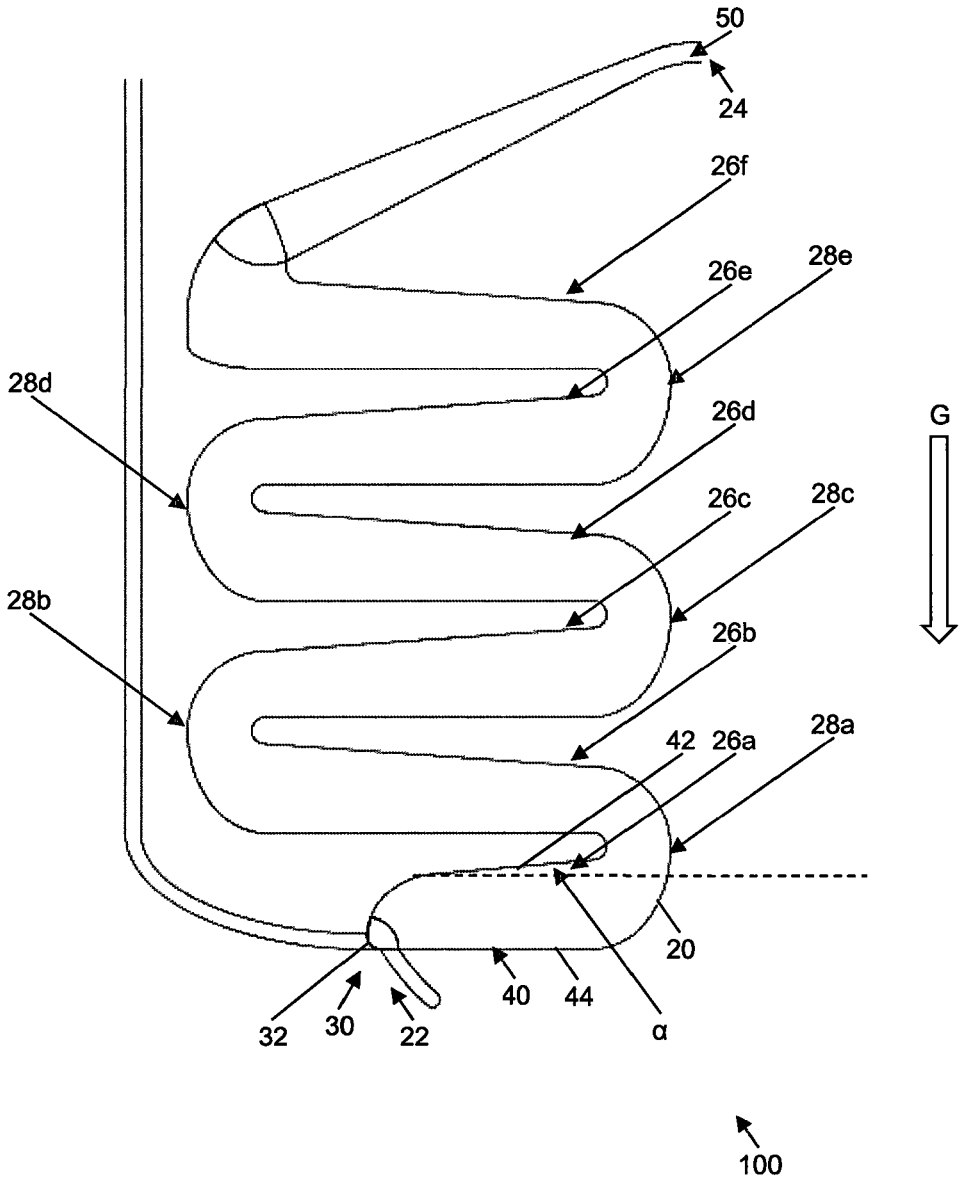
FIG. 17 schematically depicts a front cross-sectional view of a microfluidic device according to an exemplary embodiment of the invention.

FIG. 17 schematically depicts a microfluidic device 100 according to an exemplary embodiment of the invention. The microfluidic device 100 comprises a microfluidic chamber (also known as a channel) 20, having an inlet 30, and arranged to receive a liquid (not shown) therein. In use, the microfluidic device 100 is arranged to control translation through the liquid of a body (not shown) introduced therein via the inlet 30, wherein the translation of the body is due to a potential field G acting on the body. In use, the controlled translation of the body mixes the liquid.

The microfluidic chamber 20 has a volume of 300 μl and a width of 2000 μm. The microfluidic chamber 20 is substantially tubular and has an aspect ratio of about 3. An internal cross-section of the microfluidic chamber 20 is substantially rectangular, having straight sides and radiused internal corners between the sides. The internal cross-section of the microfluidic chamber 20 is non-constant along a length L of the microfluidic chamber 20. The shape of the internal cross-section of the microfluidic chamber 20 is substantially constant along the length L of the microfluidic chamber 20 while a size of the internal cross-section of the microfluidic chamber is non-constant along the length L of the microfluidic chamber 20. The size of the internal cross-section of the microfluidic chamber 20 successively increases and then decreases along the length L of the microfluidic chamber 20. This particular shape allows for the effective use of bubbles for the mixing and at the same time the complete emptying of the liquid contained within the chamber with a slug-flow, generated at airflow rates compatible with microfluidic devices.

The microfluidic chamber 20 comprises a wall 40 arranged to, in part, control translation through the liquid of the body, in use. The wall 40 comprises an upper or first wall portion 42 opposed to a lower or second wall portion 44. The first wall portion 42 is arranged to, in part, control translation through the liquid of the body, in use. The first wall portion 42 is arranged transversally with respect to the gravitational potential field G and thereby inhibits or hinders ascension of the body through the liquid. The first wall portion 42 is inclined or tilted with respect to the second side wall portion 44 by an angle of inclination a in a range 4° to 5°. The wall 40 is arranged boustrophedonically (i.e. in a zig-zag manner, alternately left to right then right to left). The boustrophedonic arrangement of the wall 40 provides six (6) relatively longer portions 26 (26*a*-26*f*) of the microfluidic chamber 20 arranged transversally to and alternately with five (5) relatively shorter portions 28 (28*a*-28*e*) of the microfluidic chamber. The wall 40 is arranged to reduce or avoid dead volumes, for example, by reducing or eliminating internal corners or recesses. An inner surface of the wall 40 is smooth, thereby facilitating flow by reducing drag.

The inlet 30 is arranged to control introduction of the body into the liquid. The inlet 30 is arranged to form, create or generate the body. The inlet 30 comprises a gas nozzle 32 arranged to generate a gas bubble. A ratio of a cross-sectional area of the gas nozzle 32 to a cross-sectional area of the microfluidic chamber 20 proximal the inlet 30 is about 1:5.

The microfluidic device 100 comprises an outlet 50. The inlet 30 is arranged proximal one end 22 of the microfluidic chamber 20 and the outlet 50 is arranged proximal an opposed end 24 of the microfluidic chamber 20. The inlet 30 and the outlet 50 each comprise a passageway through the wall 40 of the microfluidic chamber 20. The wall 40 comprises no other passageways therethrough.

The microfluidic device 100 is manufactured from poly (methyl methacrylate) (PMMA).

Figure 18:
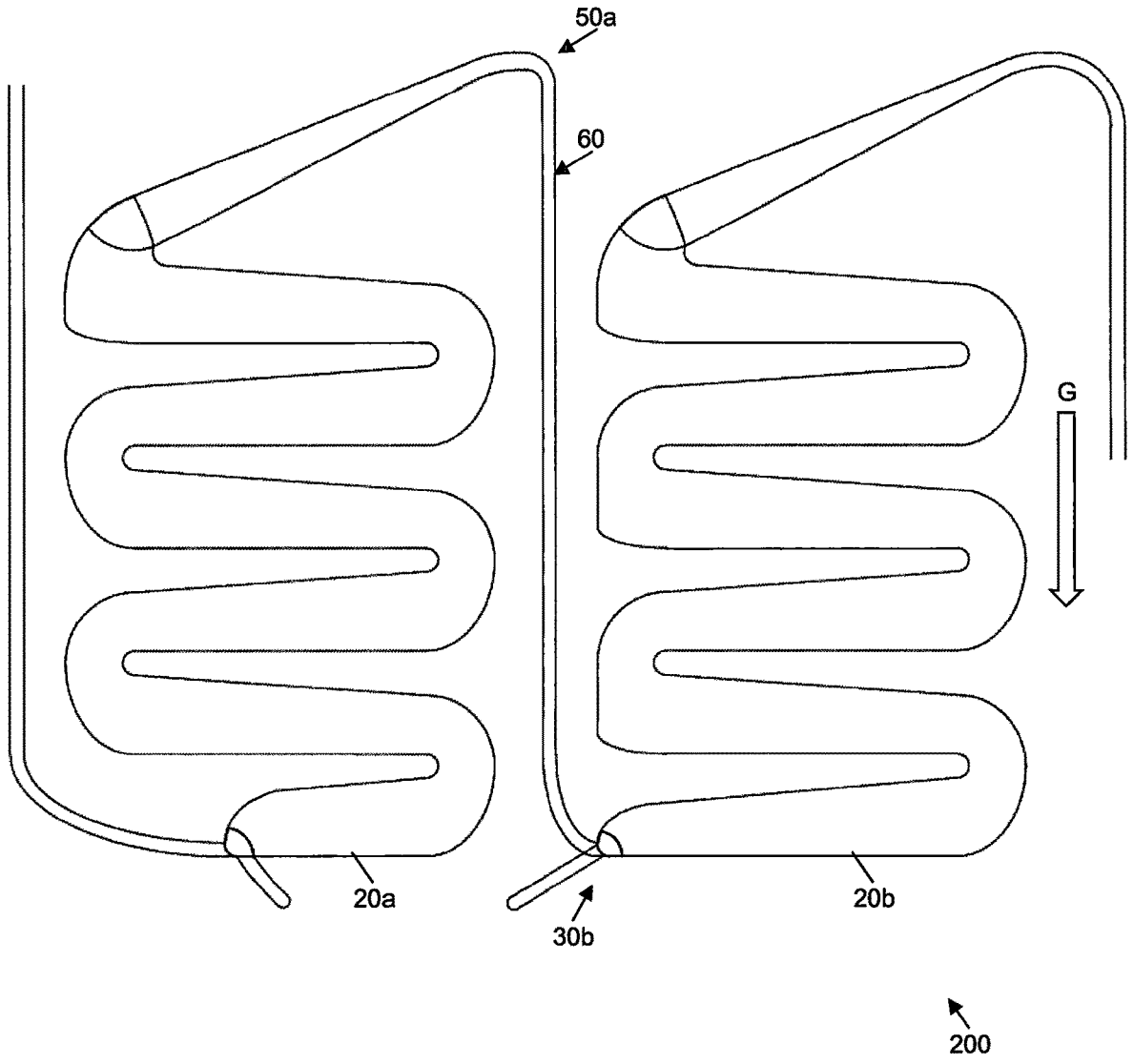
FIG. 18 schematically depicts a front cross-sectional view of another microfluidic device according to an exemplary embodiment of the invention.

FIG. 18 schematically depicts another microfluidic device 200 according to an exemplary embodiment of the invention. The microfluidic device 200 comprises two (2) (i.e. a plurality) of microfluidic chambers 20 (20*a*-20*b*), generally as described above with respect to the microfluidic device 100. Like reference signs denote like features, the reference signs suffixed consistently with the respective microfluidic chambers 20 (20*a*-20*b*).

The microfluidic device 200 comprises the first microfluidic chamber 20*a* and the second microfluidic chamber 20*b*, wherein the outlet 50*a* of the first microfluidic chamber 20*a* is fluidically coupled to the inlet 30*b* of the second microfluidic chamber 20*b* via a syphon 60.

Figure 19:
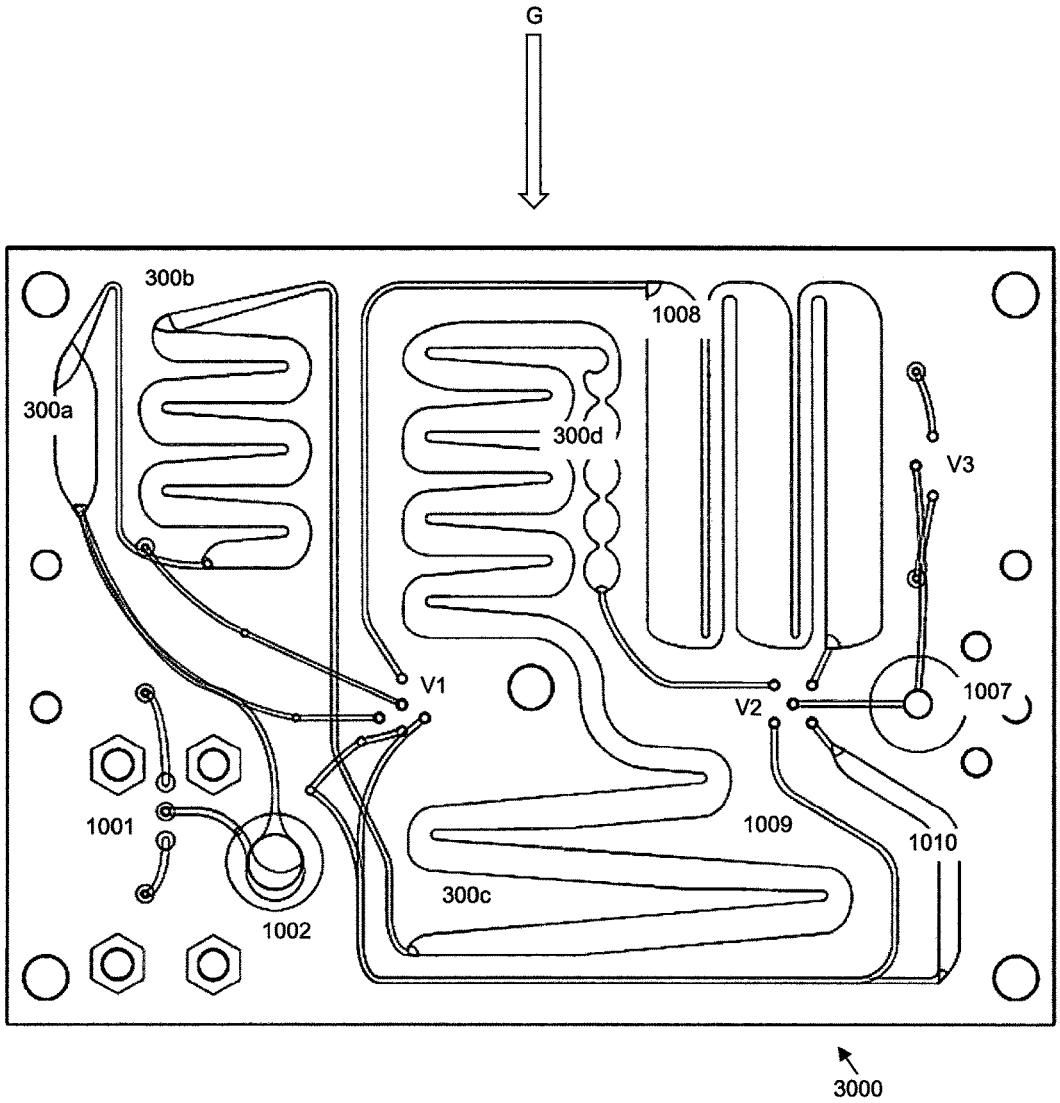
FIG. 19 schematically depicts schematically depicts a microfluidic cartridge according to an exemplary embodiment of the invention.

FIG. 19 schematically depicts schematically depicts a microfluidic cartridge 3000 according to an exemplary embodiment of the invention. The microfluidic cartridge 1000 comprises three (3) (i.e. a plurality) of fluidically-coupled microfluidic devices 300 (300*a*-300*c*). The first microfluidic device 300*a* provides a lyse buffer chamber (300 μl max), the second microfluidic device 300*a* provides a chaotropic agent chamber (1000 μl max) and the third microfluidic device 300*c* provides a mixing structure. The microfluidic cartridge 1000 also comprises a cartridge inlet (Blood Plasma Separation Chip connector) 1001, a filter (RBC filter zone) 1002, a first reservoir (Proteinase K chamber, 100 μl max) 1003, an adsorption membrane (nucleic acids adsorption membrane) 1007, a second reservoir 1008 (washing buffer chamber, 700 μl max), a third reservoir (drying air channel) 1009, a fourth reservoir (elution buffer chamber, 65 μl max) 1010, three (3) valves V1-V3 and a cartridge outlet (not shown). These components of the microfluidic cartridge 1000 are fluidically coupled so as to provide a fluid pathway between the cartridge inlet 1001 and the cartridge outlet via one or more of these components.

Figure 20:
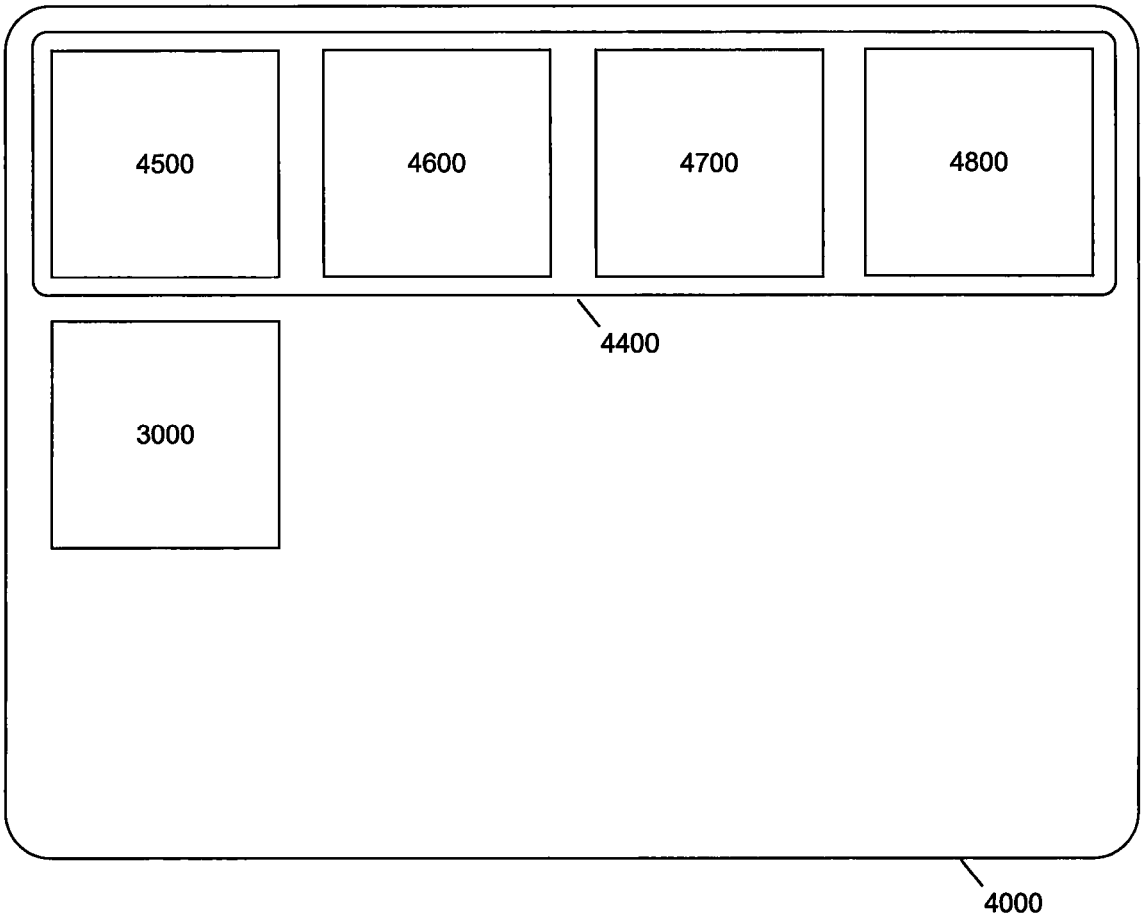
FIG. 20 schematically depicts a microfluidic system according to an exemplary embodiment of the invention.

FIG. 20 schematically depicts a microfluidic system 4000 according to an exemplary embodiment of the invention. The microfluidic system 4000 comprises an apparatus 4400 arranged to control the microfluidic cartridge 3000 and the microfluidic cartridge 3000. The apparatus 4400 comprises a controller 4500, a syringe pump 4600, a valve 4700 and a heater 4800. The controller 4500 is arranged to control the syringe pump 4600, the valve 4700 and the heater 4800. The controller 4400 is arranged to control a flow rate of the liquid and a gas into and/or through the microfluidic cartridge 3000.

Figure 21:
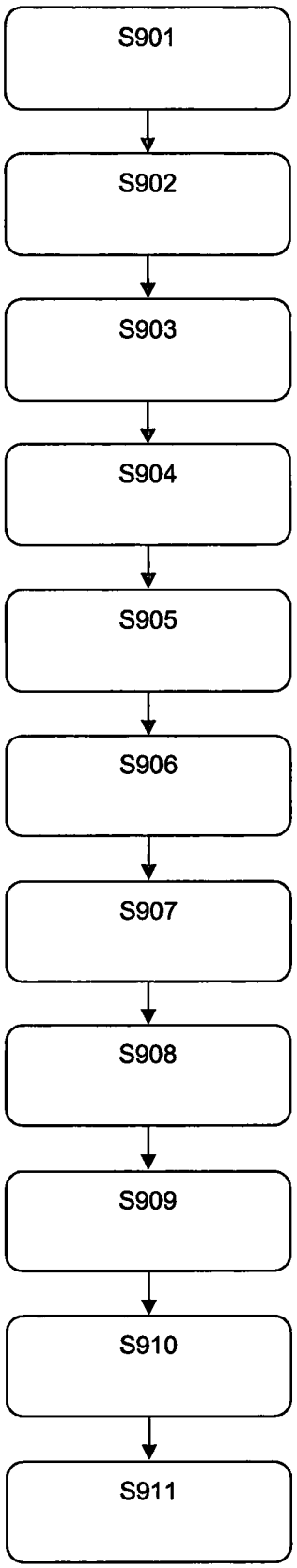
FIG. 21 schematically depicts a process of operating the microfluidic system of FIG. 20.

FIG. 21 schematically depicts a process of operating the microfluidic system of FIG. 20.

At S901, inlet sample enters the cartridge with a flow rate of 10 ml/hr and it is processed through the blood plasma separation (BPS) microfluidic structures. The stream is divided, by hydrodynamic separation, in a red blood cells enriched stream and a virtually cell free plasma stream. RBC enriched stream goes to waste while the plasma stream goes on to the downprocessing steps within the automated cartridge.

At S902, a filter eliminates the residual red and white blood cells that might escape the hydraulic separation, avoiding PCR inhibition and genomic contamination of the sample.

At S903, purified plasma mixes with Proteinase K in the first chamber. The air present within the channels, displaced by the fluid, creates bubbles that rise to the free surface and are pushed to the next chamber. Proteinase K digests proteins, such as nuclease, that would degrade the nucleic acids in the sample.

At S904, as the syringe pump pushes fresh sample through the BPS, the fluid which filled chamber 3 is pushed to the next chamber where mixes with the lyse buffer. In this step nucleic acids are released from microvesicles and from protein complexes they are bound to.

At S905, the sample finally mixes with the chaotropic agent. This step changes the stability of the solution and creates the conditions for the bonding of the nucleic acids on the silica membrane.

At S906, once the whole inlet sample is processed, air is pushed inside the cartridge at 100 ml/hr through a chamber filled with chaotropic agent and directly connected to the plasma lines, straight after the filtering zone. The bubble stream that is produced enhances mixing of sample and reagents. The presence of chaotropic agent in the first and last chamber ensure that adsorption conditions are fulfilled during the whole extraction.

At S908, mixing structures delay the exit of fluid and enhance sample uniformity. These structures include enlargements and constrictions along the section, to create velocity gradients and whirls in the fluid, plus a backmixing effect due to the different time fillets of fluid will employ to cross them.

At S908, increasing the air flow rate to 550 ml/hr produces larger bubbles and successfully pushes the entirety of the fluid through the adsorption membrane. After nucleic acids adsorption the sample leaves the cartridge through a waste channel.

At S909, turning valves (v) switches fluidic connections within the cartridge. Air can now be used to push a washing buffer through the membrane. Air flow rate ranges from 100 to 550 ml/hr to ensure the thorough emptying of the reagent chamber. This process removes proteins and other impurities that can be adsorbed on the membrane and that would contaminate the sample and inhibit amplification.

At S910, the membrane is then dried for 5 minutes through air flow with alternate direction at 550 ml/hr. To ease the drying, the area above the membrane is heated to 50° C. by mean of an electric heater and thermal controller. The heater is integrated in the electric module that controls the stepper motors that turns the valves and the syringe pumps. An effective drying removes all the chaotropic agent, allowing for a more effective sample elution.

At S911, after drying, valves are turned again, switching the fluidic path within the cartridge. An air flow of 10 ml/hr ensures the slow and effective elution of the nucleic acids from the membrane in 65 ml of elution buffer. The cfNAs elution is collected in a fresh tube through a clean channel specifically opened with the valves rotation. The whole protocol takes about 40 minutes when starting from 5 ml of whole blood and does not require trained staff to assist the automated platform during the extraction. In contrast, conventional protocols take about 1.5-2 hours and may require trained staff.

Although a preferred embodiment has been shown and described, it will be appreciated by those skilled in the art that various changes and modifications might be made without departing from the scope of the invention, as defined in the appended claims and as described above.

In summary, the invention provides a fluidic device that improves control of an amount of fluid expelled therefrom, for example that improves accuracy and/or a precision of the amount of the fluid expelled therefrom. In this way, the fluidic device is suitable for use with LOC devices for POC applications.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims and drawings), and/or all of the steps of any method or process so disclosed, may be combined in any combination, except combinations where at most some of such features and/or steps are mutually exclusive.

Each feature disclosed in this specification (including any accompanying claims, and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims and drawings), or to any novel one, or any novel combination, of the steps of any method or process so disclosed.

The invention claimed is:

1. A fluidic device comprising:

a first part comprising:

a first inlet and a first outlet, mutually spaced apart and each comprising respective perforation members; and a second inlet, fluidically coupled to the first outlet via a channel, and a second outlet, mutually spaced apart and each comprising respective perforation members; and a second part in the form of a liquid-filled blister pack comprising:

a first blister providing a first chamber containing a predetermined first amount of a first fluid therein and a first wall portion arranged to contain, at least in part, the first fluid in the first chamber; and a second blister providing a second chamber containing a predetermined second amount of a second fluid therein and a second wall portion arranged to contain, at least in part, the predetermined second amount of the second fluid in the second chamber;

wherein the fluidic device is arrangeable in:

a first configuration, wherein the first fluid is isolated in the first chamber and the first part is fluidically isolated from the first chamber, and wherein the second fluid is isolated in the second chamber and the first part is fluidically isolated from the second chamber; and a second configuration, wherein the first inlet and the first outlet are fluidically coupled via the first chamber, whereby increasing a first pressure in the first chamber via the first inlet urges at least a part of the predetermined first amount of the first fluid through the first outlet, and wherein the second inlet and the second outlet are fluidically coupled via the second chamber, whereby increasing the first pressure in the first chamber via the first inlet urges at least a part of the predetermined second amount of the second fluid through the second outlet;

wherein:

the fluidic device is arranged to move from the first configuration to the second configuration by the first inlet and the first outlet perforating through the first wall portion into the first chamber and by the second inlet and the second outlet perforating through the second wall portion into the first chamber;

the first wall portion is arranged to fluidically seal around the first inlet and the first outlet in the second configuration;

the second wall portion is arranged to fluidically seal around the second inlet and the second outlet in the second configuration; and the fluidic device further comprises a first coupling member arranged to couple the first part and the second part in the second configuration and the first coupling member is selected from at least one of a mechanical coupling and a coupling which interlocks the first part and the second part.

2. The fluidic device according to claim 1, comprising a second coupling member arranged to moveably couple the first part and the second part in the first configuration.

3. The fluidic device according to claim 2, wherein the second coupling member comprises a hinge or a pivot, arranged to rotatably couple the first part and the second part in the first configuration and/or the second configuration, to guide movement of the fluidic device from the first configuration to the second configuration.

4. The fluidic device according to claim 1, wherein at least one of:

a length of the first outlet corresponds with a maximum depth of the first chamber, or a location of the first outlet corresponds with a location of the maximum depth of the first chamber.

5. The fluidic device according to claim 1, wherein the first inlet is fluidically couplable to a gas source, whereby gas provided by the gas source is arranged to displace the first fluid via the first inlet.

6. The fluidic device according to claim 1, wherein the first wall portion comprises a first layer coupled to a first edge of the first chamber.

7. The fluidic device according to claim 1, wherein the second part is formed, at least in part, from a sheet material and wherein the first chamber comprises a concavity formed therein.

8. The fluidic device according to claim 1, wherein the fluidic device is a microfluidic device.

9. The fluidic device according to claim 1, wherein the first part comprises a laboratory on a chip device, and wherein the first fluid is a reagent.

10. A method of controlling a fluidic device according to claim 1, the method comprising:

moving the fluidic device from the first configuration to the second configuration; and increasing a first pressure in the first chamber via the first inlet thereby urging at least a part of the predetermined first amount of the first fluid through the first outlet and urging at least a part of the predetermined second amount of the second fluid through the second outlet.

11. The fluidic device according to claim 1, wherein the first chamber comprises a set of antechambers, the set of antechambers comprising:

a first inlet antechamber which is arranged to correspond with the first inlet of the corresponding first part of the fluidic device and which has a wall portion arranged to support the first wall portion by substantially surrounding the first inlet antechamber; and a first outlet antechamber which is arranged to correspond with the first outlet of the corresponding first part of the fluidic device and which has a wall portion arranged to support the first wall portion by substantially surrounding the first outlet antechamber.

12. The fluidic device according to claim 11, wherein the first inlet antechamber and the first outlet antechamber are arranged proximal a first side of the first chamber, whereby the first inlet antechamber and the first outlet antechamber are arrangeable in use proximal a lower side of the first chamber.

13. The fluidic device according to claim 11, wherein the first inlet antechamber and the first outlet antechamber are arranged at a first side of the first chamber, whereby the first inlet antechamber and the first outlet antechamber are arrangeable in use at a first side a lower side of the first chamber.

14. The fluidic device according to claim 12, wherein the set of antechambers includes a second outlet antechamber arranged to correspond with the second outlet of the corresponding first part of the fluidic device.

15. The fluidic device according to claim 14, wherein the second outlet antechamber is arranged proximal an opposed second side of the first chamber, whereby the second outlet antechamber is arrangeable in use proximal the first chamber and the first inlet antechamber is arrangeable in use proximal the first chamber.

16. The fluidic device according to claim 1, wherein the first part and the second part are integrally formed as a single component.

17. The fluidic device according to claim 1, wherein the first coupling member comprises a fastener on the first part arranged to fasten through an aperture in or against a surface of the second part, or vice versa.

* * * * *